US006602032B2

(12) United States Patent
Arai

(10) Patent No.: US 6,602,032 B2
(45) Date of Patent: Aug. 5, 2003

(54) METHOD FOR HANDLING GOODS

(75) Inventor: Tomoaki Arai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 101 days.

(21) Appl. No.: 09/734,179

(22) Filed: Dec. 12, 2000

(65) Prior Publication Data

US 2001/0051079 A1 Dec. 13, 2001

(30) Foreign Application Priority Data

Dec. 20, 1999 (JP) ..... 11-361711

(51) Int. Cl.[7] ..... B65D 19/12; B65D 19/40; B65D 19/44

(52) U.S. Cl. ..... 410/46; 108/55.1; 108/55.3; 108/56.1; 108/56.3

(58) Field of Search ..... 108/55.1, 55.3, 108/56.1, 56.3, 57.16; 410/46, 66, 67, 94

(56) References Cited

U.S. PATENT DOCUMENTS

| | | | | | |
|---|---|---|---|---|---|
| 564,740 | A | * | 7/1896 | Dietz | 296/43 |
| 999,828 | A | * | 8/1911 | McNaughton | 410/94 |
| 1,522,707 | A | * | 1/1925 | Andrews et al. | 414/803 |
| 2,828,932 | A | * | 4/1958 | DePew et al. | 108/53.5 |
| 2,971,768 | A | * | 2/1961 | Ackley et al. | 280/35 |
| 3,168,060 | A | * | 2/1965 | Farley | 108/53.5 |
| 3,193,093 | A | * | 7/1965 | Hansen | 206/451 |
| 3,405,665 | A | * | 10/1968 | Slonim | 180/55.1 |
| 4,027,599 | A | * | 6/1977 | Sapp et al. | 108/55.1 |
| 4,437,412 | A | * | 3/1984 | Trautsch | 108/56.1 |
| 4,703,702 | A | * | 11/1987 | Speicher | 108/56.3 |
| 4,856,434 | A | * | 8/1989 | Smith | 108/53.1 |
| 4,915,033 | A | * | 4/1990 | Bond | 108/55.1 |
| 5,016,761 | A | * | 5/1991 | Stoddard et al. | 211/59.4 |
| 5,233,931 | A | * | 8/1993 | McCorkle, Jr. | 108/55.1 |
| 5,320,481 | A | * | 6/1994 | Suzuki | 414/799 |
| 5,647,284 | A | * | 7/1997 | Frysinger et al. | 108/55.1 |
| 5,655,863 | A | * | 8/1997 | Mundt | 410/94 |
| 5,918,551 | A | * | 7/1999 | Liu | 108/55.1 |
| 6,286,792 | B1 | * | 9/2001 | Best | 248/97 |
| 6,343,555 | B1 | * | 2/2002 | Arai et al. | 108/53.5 |
| 6,402,167 | B1 | * | 6/2002 | Calleja | 280/79.3 |
| 6,463,863 | B1 | * | 10/2002 | Ishikawa et al. | 108/53.1 |

FOREIGN PATENT DOCUMENTS

| | | |
|---|---|---|
| JP | 10-236531 | 9/1998 |
| JP | 11-208663 | 8/1999 |

* cited by examiner

*Primary Examiner*—D. Glenn Dayoan
*Assistant Examiner*—Paul Chenevert
(74) *Attorney, Agent, or Firm*—Oblon, Spivak, McClelland, Maier & Neustadt, P.C.

(57) ABSTRACT

A method for handling goods including the steps of selecting a goods loading member according to the size, shape, or quantity of goods, loading the goods onto the goods loading member, adjusting a space between supports according to the size of the goods loading member, attaching the supports to the goods loading member, and transporting, storing, or exhibiting the goods.

64 Claims, 17 Drawing Sheets

METHOD FOR HANDLING GOODS

FIELD OF THE INVENTION

The present invention relates to a method for handling goods.

BACKGROUND OF THE INVENTION

A conventional method of transporting or storing manufactured goods such as electrical appliances, components of the goods, various types of parts of architectural materials, furniture, and natural substances, or the like is to put the goods into corrugated-cardboard boxes. Sometimes the goods are loaded on pallets, and so on. In the conventional method, however, it is difficult to efficiently and safely transport or store the goods.

SUMMARY OF THE INVENTION

It is an object of this invention to provide a method for handling the goods in which goods can be handled efficiently and safely.

The method for handling goods according to one aspect of this invention comprises the steps of transporting, storing, or exhibiting goods using a goods loading member where the goods are loaded and a protective member which protects the goods on the goods loading member.

Further, it is preferable that the goods loading member can hold different types of goods.

Further, it is preferable that a second goods loading member is provided above the goods.

Further, it is preferable that a second goods loading member and a second protective member are provided above the goods.

Further, it is preferable that the protective member is deformable.

Further, it is preferable that the protective member can be disassembled to a plurality of members.

Further, it is preferable that the protective member is extendable.

Further, it is preferable that the protective member is formed with at least one of materials of metal, resin, and wood.

Further, it is preferable that the protective member is made of a reusable member.

The method for handling goods according to another aspect of this invention comprises the steps of transporting, storing, or exhibiting goods using a goods loading member where goods are loaded, a supporting member attachable to the goods loading member, and a supported member supported by the supporting member.

Further, it is preferable that the supporting member is deformable.

Further, it is preferable that the supporting member can be disassembled to a plurality of members.

Further, it is preferable that the supporting member is extendable.

Further, it is preferable that the supported member is a cover provided above the goods.

Further, it is preferable that the supported member is another goods loading member.

Further, it is preferable that the supported member comprises a second goods loading member and a second supporting member which are located above the goods.

Further, it is preferable that the supporting member is formed with at least one of materials of metal, resin, and wood.

Further, it is preferable that the supporting member is made of a reusable member.

The method for handling goods according to still another aspect of this invention comprises the step of loading goods into a goods loading apparatus which has a goods loading member where the goods are loaded and a plurality of supports spaced on and detachably attached to the goods loading member so as to surround the goods on the goods loading member. More specifically, two adjacent supports are coupled to each other so as to enable adjustment of the space between the two supports by making the two adjacent supports closer to or apart from each other. The method further comprises the steps of transporting, storing, or exhibiting the goods.

The method for handling goods according to still another aspect of this invention comprises the step of loading goods into a goods loading apparatus which has a goods loading member where the goods are loaded and a plurality of supports spaced on and detachably attached to the goods loading member so as to surround the goods on the goods loading member. More specifically, two adjacent supports are coupled to each other so as to enable adjustment of the space between the two supports by making the two adjacent supports closer to or apart from each other. The method further comprises the steps of transporting the goods, unloading the goods from the goods loading apparatus, loading trade-in goods into the relevant goods loading apparatus, and transporting the goods to other sites.

The method for handling goods according to still another aspect of this invention comprises the step of loading goods into a goods loading apparatus which has a goods loading member where the goods are loaded and a plurality of supports spaced on and detachably attached to the goods loading member so as to surround the goods on the goods loading member. More specifically, two adjacent supports are coupled to each other so as to enable adjustment of a space between the two supports by making the two adjacent supports closer to or apart from each other. The method further comprises the steps of transporting the goods, unloading the goods from the goods loading apparatus, loading trade-in goods on a goods loading apparatus in which a space between supports are adjusted according to the size, the shape, and the quantity of the trade-in goods, and transporting the goods to other sites.

The method for handling goods according to still another aspect of this invention comprises the steps of manufacturing goods on a goods loading member at the time of manufacturing the goods, and attaching a plurality of supports, in which a space between two adjacent supports is adjustable, to the goods loading member by the time the goods are shipped.

The method for handling goods according to still another aspect of this invention comprises the step of loading a plurality of goods loading apparatuses with goods to be assembled at different sites, respectively. More specifically, each of the goods loading apparatuses has a goods loading member where the goods are loaded and a plurality of supports spaced on and detachably attached to the goods loading member so as to surround the goods on the goods loading member. Further, two adjacent supports are coupled to each other so as to enable adjustment of a space between the two supports by making the two adjacent supports closer to or apart from each other. The method further comprises the steps of transporting the goods to an assembly site, detaching the supports of one of the goods loading apparatuses from its goods loading member but unloading the goods on the relevant goods loading apparatus from its goods loading member at the assembly site, mounting the goods unloaded from the other goods loading apparatus to the goods on the relevant goods loading member, attaching again the supports to the goods loading member where the assembled goods are loaded, and transporting the goods loaded in the goods loading apparatus to other sites.

The method for handling goods according to still another aspect of this invention comprises the steps of visiting a site to pick up used goods with a plurality of prepared goods loading members of different sizes, selecting a goods loading member according to the size, the shape, and the quantity of the used goods to be picked up, loading the used goods onto the selected goods loading member, attaching a plurality of supports, in which a space between two adjacent supports is adjustable, to the relevant goods loading member, and transporting the used goods.

Further, it is preferable that a pickup fee for used goods is determined based on the size of the selected goods loading member or the area occupied by the goods on the goods loading member.

According to still another aspect of this invention, a method for handling goods is proposed. This method is performed by using a goods loading apparatus which has a goods loading member where goods are loaded and a plurality of supports spaced on and detachably attached to the goods loading member so as to surround the goods on the goods loading member. More specifically, two adjacent supports are coupled to each other so as to enable adjustment of the space between the two supports by making the two adjacent supports closer to or apart from each other. The method for handling goods comprises the steps of loading used goods into the goods loading apparatus in which a space between supports are adjusted according to the size, the shape, and the quantity of the used goods and transporting them to a sales exhibit, exhibiting the used goods remaining loaded on the goods loading member of the goods loading apparatus at the sales exhibit, and transporting the used goods loaded in the goods loading apparatus to a dealer to take the used goods.

Further, it is preferable that an instruction manual of goods is kept in a case different from the goods loading apparatus for carriage.

According to still another aspect of this invention, a method for handling goods is proposed. This method is performed by using a goods loading apparatus which has a goods loading member where goods are loaded and a plurality of supports spaced on and detachably attached to the goods loading member so as to surround the goods on the goods loading member. More specifically, two adjacent supports are coupled to each other so as to enable adjustment of a space between the two supports by making the two adjacent supports closer to or apart from each other. When a forwarding agent transports goods from one site to another, transportation charges are determined based on at least one of the volume of a goods loading apparatus and the size of a goods loading member when the goods are loaded in the goods loading apparatus.

Further, it is preferable that goods are covered with a cover and loaded in a goods loading apparatus.

Further, it is preferable that a cover, through which the goods covered with the cover are visible from the outside, is used.

Further, it is preferable that a goods loading apparatus, through which the goods loaded in the goods loading apparatus is visible from the outside, is used.

Further, it is preferable that a goods loading apparatus is used. More specifically, this apparatus is allowed to make a plurality of supports detached from the goods loading member close to each other keeping them in their substantially parallel state, and fold them up.

Other objects and features of this invention will become apparent from the following description with reference to the accompanying drawings.

DESCRIPTION OF THE PREFERRED EMBODIMENTS

Preferred embodiments of this invention will be explained in detail below with reference to the related drawings.

An example of a goods loading apparatus with which the method for handling goods in this embodiment is executed will be explained first, and then the method for handling goods will be disclosed.

Figure 1:
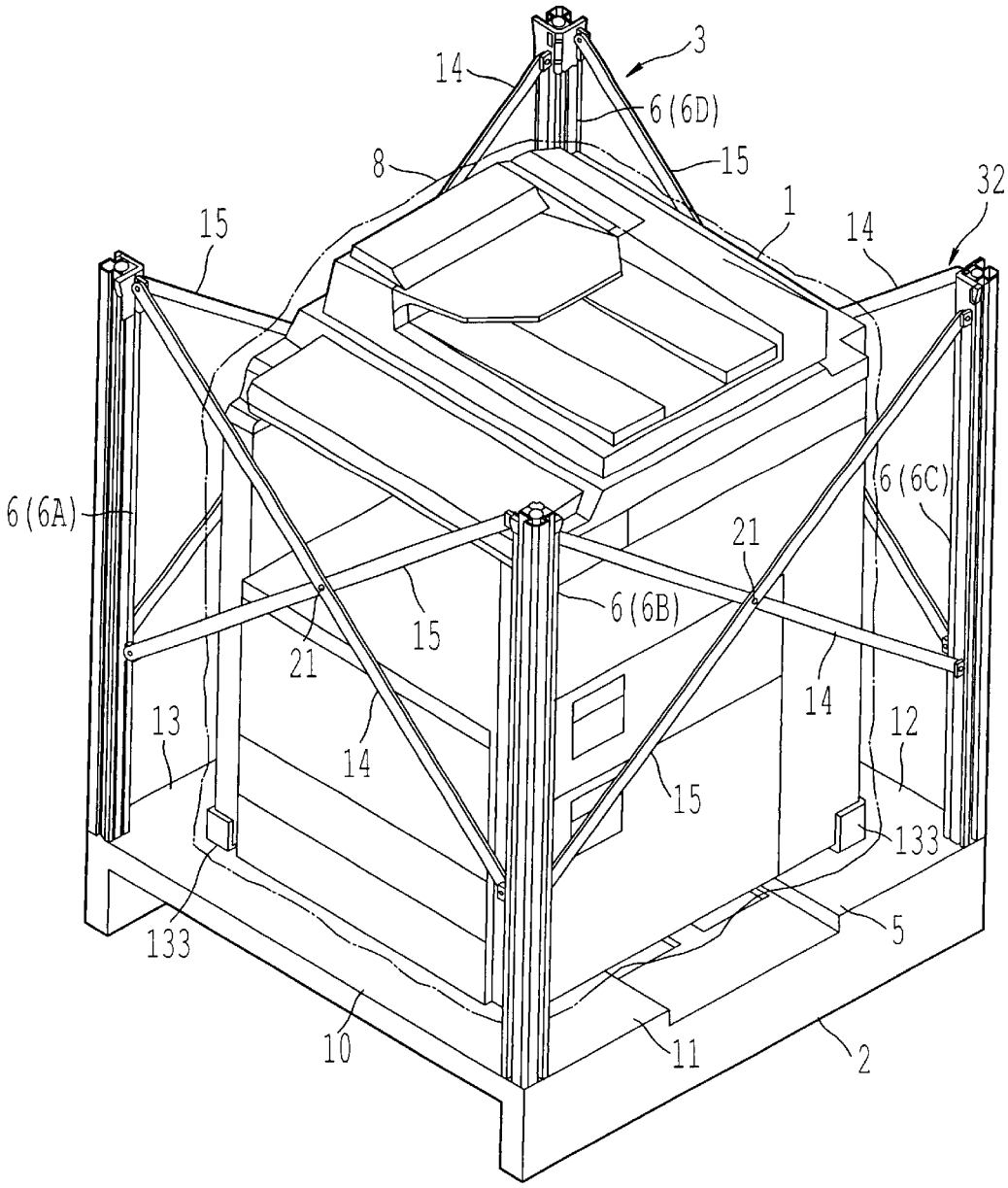
FIG. 1 shows a perspective view of an example of the goods loading apparatus where goods are loaded.
Figure 2:
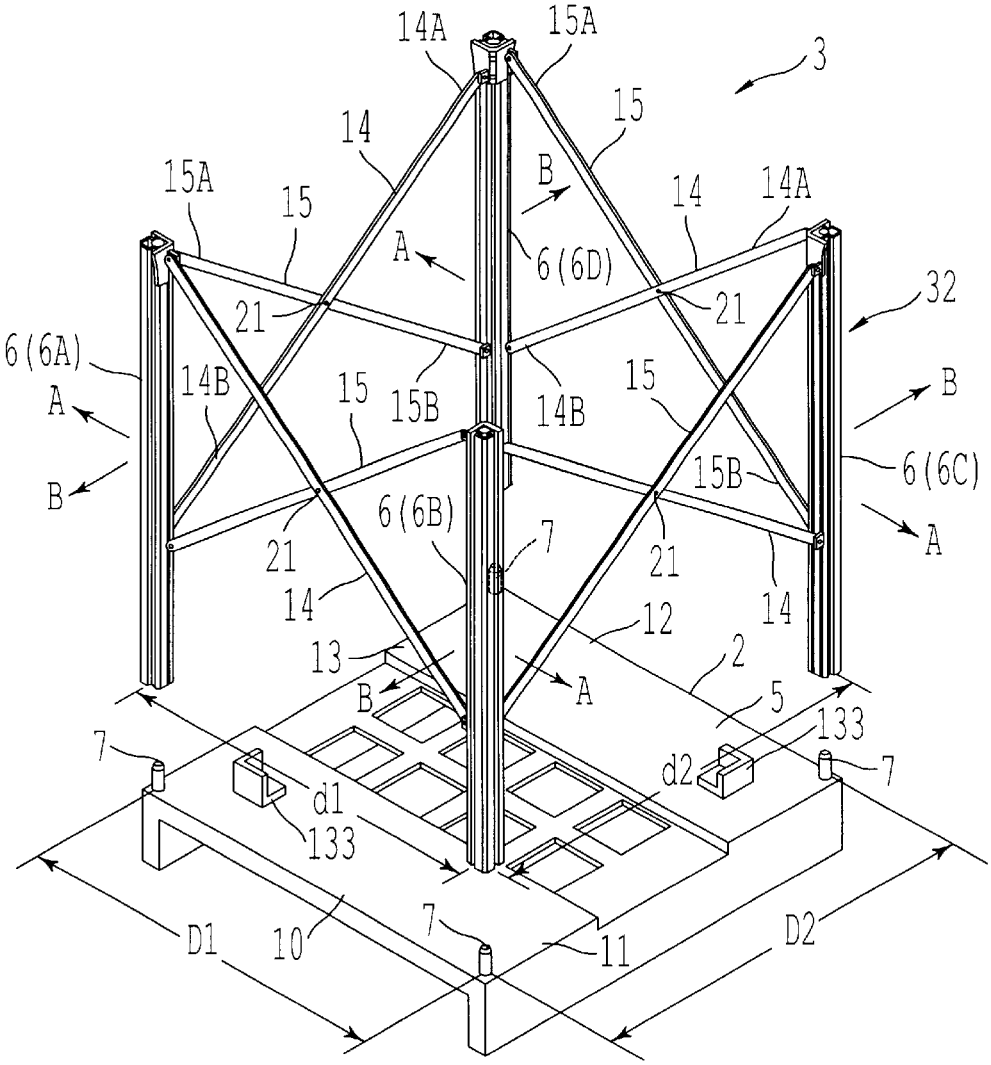
FIG. 2 shows a perspective view of a state before the supports are attached to the goods loading member.

A goods loading apparatus 3 shown in FIG. 1 has a goods loading member 2 formed as a pallet for loading goods 1 such as a copier, and a plurality of supports 6, four supports in the example shown in the figure, spaced on and detachably attached to the goods loading member 2 so as to surround the goods 1 loaded on the goods loading member 2. FIG. 2 shows a state before the supports 6 are attached to the goods loading member 2. As shown in this figure, the goods loading member 2 has four projections 7 provided on a top surface 5 of the member where goods are loaded. Each of the supports 6 has a center hole 62 (FIG. 3) extending along its length as explained later. The goods loading member 2 and the supports 6 are formed with a material such as resin, metal, or wood.

When the goods 1 are to be transported or stored, the goods 1 are loaded on the goods loading member 2 as shown in FIG. 1 before the supports 6 are attached to the goods loading member 2. As indicated by dot-dash lines in FIG. 1, a cover 8 may be put over the goods 1 for protection. By using a transparent soft resin sheet or a net such as a vinyl sheet as the cover 8, the goods 1 can visually be checked through the cover 8.

Subsequently, the supports 6 held by hand are lowered, as shown in FIG. 2, from the upper side of the goods loading member 2 to engage the lower parts of the supports 6 with the projections 7. At this time, the supports 6 surround the goods 1 on the goods loading member 2 in their almost upright state with respect to the top surface 5 of the goods loading member 2 where the goods are loaded, and each pair of the supports 6 are located adjacent to each other on the sides 10, 11, 12, and 13 of the goods loading member 2. The supports 6 can be detached from the goods loading member 2 by holding the supports 6 by hand and pulling them upward. In the explanation below, the four supports 6 are referred to as a first support 6A, a second support 6B, a third support 6C, and a fourth support 6D, respectively, as required.

Of the plurality of supports 6, two adjacent supports are coupled to first and second coupling members 14 and 15, which are arranged in their crossed state, via respective joints as explained below.

Figure 3:
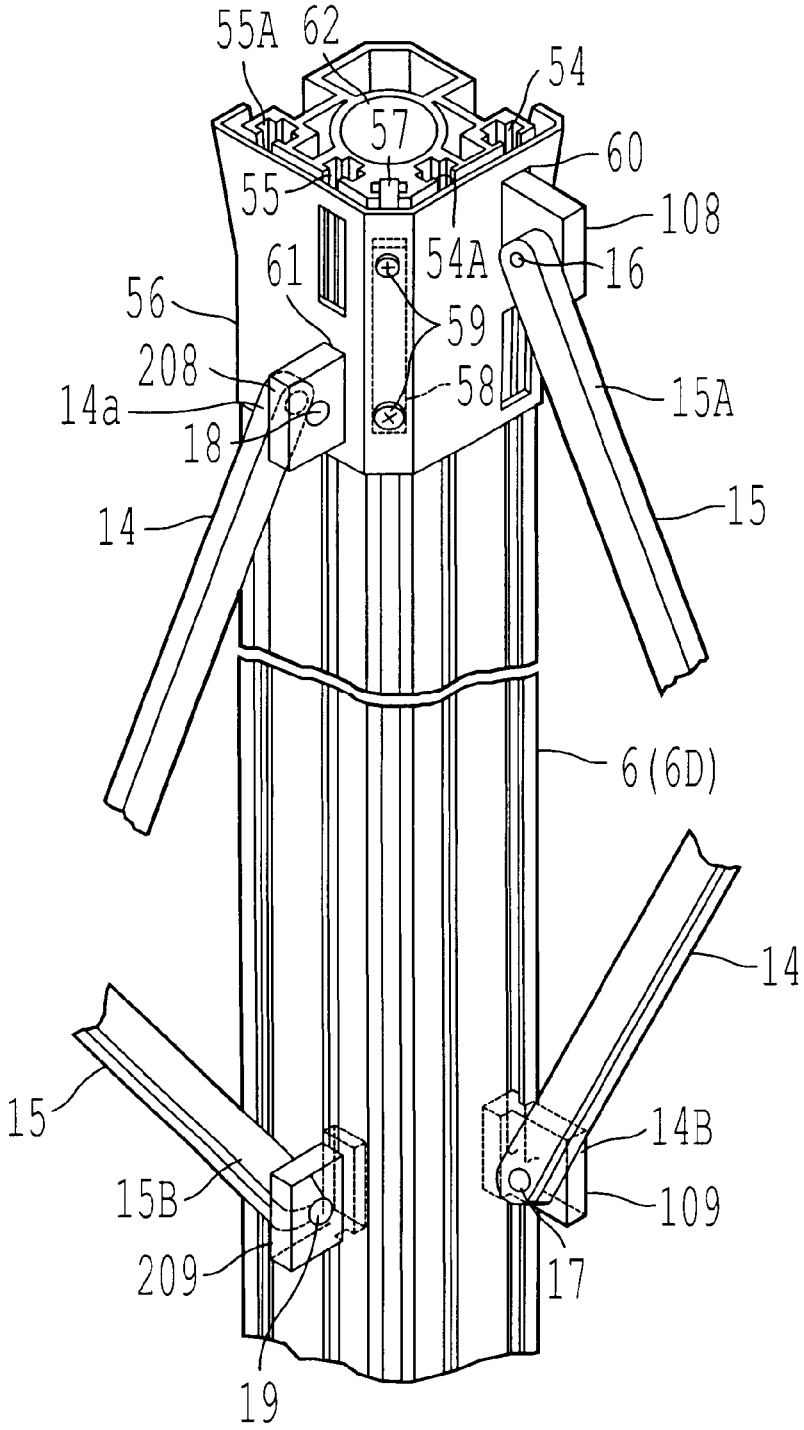
FIG. 3 shows a perspective view of joints attached to the support.
Figure 4:
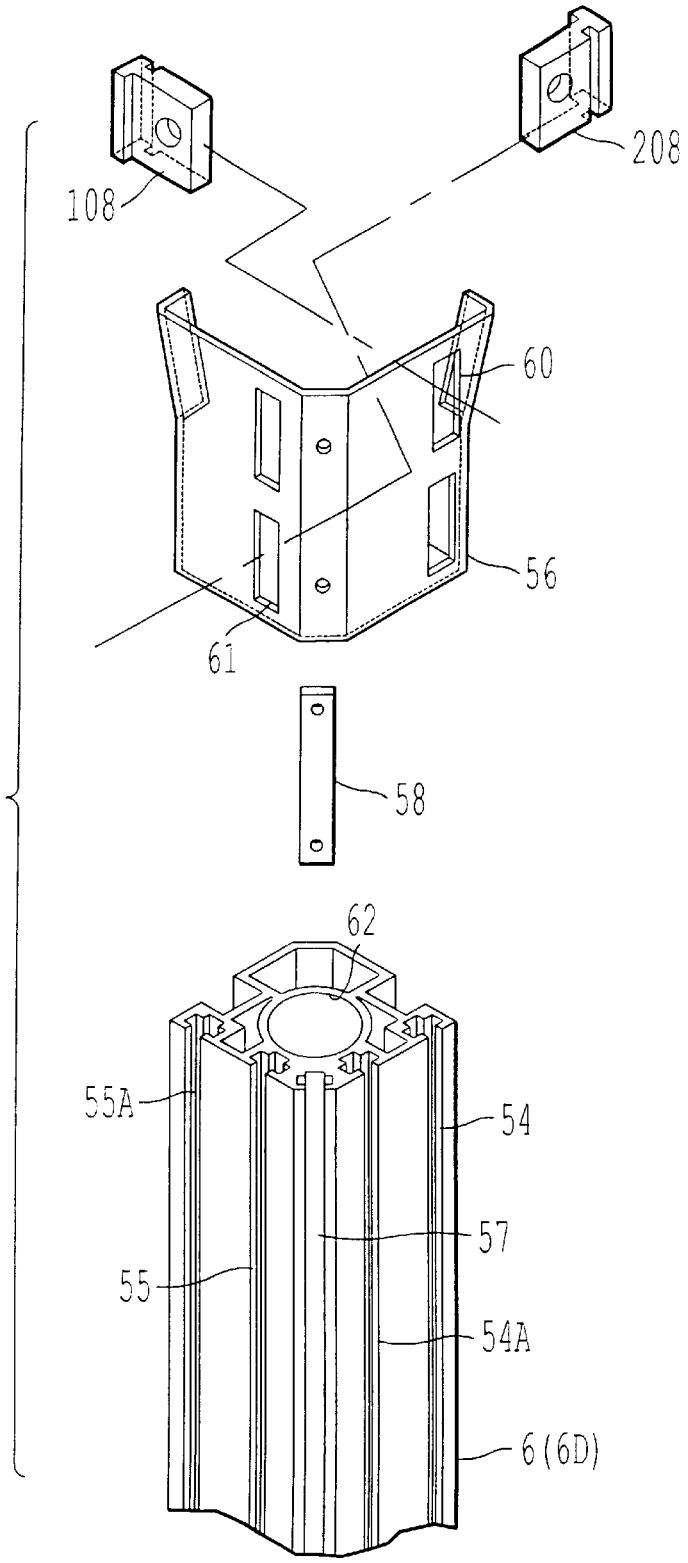
FIG. 4 shows an exploded perspective view of FIG. 3.

FIG. 3 shows the fourth support 6D as the typical one of the supports for the goods loading apparatus 3 shown in FIG. 1 and FIG. 2, and also shows an enlarged perspective view of the joint attached to the support. FIG. 4 is a partially exploded perspective view of the support. In these figures, guide grooves 54 and 55 extending parallel to each other are formed along the length of the support 6 in its longitudinal direction. The bases of first joints 108 and 208 formed with small parts are fitted into the upper ends of the guide grooves 54 and 55, respectively. Another groove 57 extending along the length of the support 6 is formed on the corner of the support 6, and a plate-shaped nut 58 is fitted into the groove 57 so that the nut is slidable along the groove 57. The two first joints 108, 208, and the nut 58 are inserted into the grooves 54, 55, and 57 from the upper end or the lower end of the support 6. The inserted first joints 108, 208, and nut 58 are slidable with respect to the grooves 54, 55, and 57, yet not detached in the radius direction of the support 6.

A fixing member 56 made of metal or a resin plate or the like is disposed on the upper side of the support 6, and the first joints 108 and 208 are fitted through holes 60 and 61 formed on the fixing member 56 so that the first joints 108 and 208 do not rattle. Screws 59 are put through into two holes formed on the fixing member 56, and the screws 59 are screwed into the screw holes of the nut 58 fitted into the groove 57. Accordingly, the fixing member 56 and the two first joints 108 and 208 are firmly secured to the support 6, respectively.

Base edges of second joints 109 and 209, formed with small parts, are slidably fitted into the guide grooves 54 and 55 without being detached in the radial direction of the support 6. As explained above, the center hole 62 extending along the length of the support 6 is formed at the center of the support 6, and by fitting the projection 7 shown in FIG. 2 into the lower part of the center hole 62, the support 6 is detachably attached to the goods loading member 2.

The other supports 6A, 6B, and 6C shown in FIG. 1 and FIG. 2 are structured in the same manner as explained above, and the two first and the two second joints are attached to each of the supports 6A, 6B, and 6C in the substantially same manner as the above case. Therefore, explanation on the structure of the supports 6A, 6B, and 6C and the structure of the first and second joints attached to each of the supports will be omitted.

On the other hand, as shown in FIG. 1 and FIG. 2, the first and second coupling members 14 and 15 provided between two adjacent supports 6 are made of a rigid body such as metal, hard resin, or wood, and formed in a linearly extending rod or bar. Both of the coupling members 14 and 15 are pivotally coupled to each other by a pin 21 at the middle part of the members. However, both of the crossed coupling members 14 and 15 may be free from each other without the pin 21.

Let us consider the two adjacent third and fourth supports 6C and 6D as shown in FIG. 2 and also the first and the second coupling members 14 and 15 provided between these supports 6C and 6D. The upper end side 15A of the second coupling member 15 is coupled pivotally via a pin 16 to the first joint 108 of the two first joints 108 and 208 fixed to the fourth support 6D as shown in FIG. 3. The lower end side 15B of the second coupling member 15 is coupled pivotally via a pin to one of the two second joints (see FIG. 3) slidably attached to the third support 6C as is clear from FIG. 2.

On the other hand, the upper end side 14A of the first coupling member 14 provided between the third support 6C and the fourth support 6D is coupled pivotally via a pin to one of the two first joints (see FIG. 3) fixed to the third support 6C. While the lower end side 14B of the first coupling member 14 is coupled pivotally via a pin 17 to the second joint 109 of the two second joints 109 and 209 slidably attached to the fourth support 6D as shown in FIG. 3.

In the same manner as the above case, the upper end side 14A of the first coupling member 14 provided between the first support 6A and the fourth support 6D is coupled pivotally via a pin 18 to the other first joint 208 shown in FIG. 3. While the lower end side 14B of the first coupling member 14 is coupled pivotally via a pin to the other second joint (see FIG. 3) slidably attached to the first support 6A. Likewise, the upper end side 15A of the second coupling member 15 provided between the first support 6A and the fourth support 6D is coupled pivotally via a pin to one of the first joints (see FIG. 3) fixed to the first support 6A. While the lower end side 15B of the second coupling member 15 is coupled pivotally via a pin 19 to the other second joint 209 slidably attached to the fourth support 6D as shown in FIG. 3.

The first and the second coupling members 14 and 15 provided between the first support 6A and the second support 6B, and between the second support 6B and the third support 6C, respectively, are also coupled to respective supports via the first and the second joints in the exactly same manner as explained above.

The first and the second coupling members 14 and 15 crossing each other are displaced from each other by a slight amount in the horizontal direction. Therefore, the first and the second joints, to which the ends of the coupling members 14 and 15 are coupled, can also be fitted into guide grooves 55A and 54A (see FIG. 3) of the supports other than the support 6D so that, when the two coupling members 14 and 15 pivot about the pin 21 as explained later, the pivot can smoothly be performed. These guide grooves 54A and 55A extend parallel to the guide grooves 54 and 55, respectively, in the longitudinal direction of the support 6.

The four supports 6 are attached to the goods loading member 2 in the above manner. Various sizes of the goods loading member 2 are prepared according to the size, the shape, and the quantity of goods 1 to be loaded on the goods loading member 2. Any goods loading member 2 suitable for the size, the shape, and the quantity of the goods 1 is selected, and the goods 1 are loaded on the top surface 5 of the member. At this time, although the distances D1 and D2 (FIG. 2) between the respective projections 7 may be different depending on the size of the selected goods loading member 2, distances d1 and d2 between the supports 6 before being attached to the goods loading member 2 are adjusted in the following manner so as to match the distances D1 and D2.

The two first and second supports 6A and 6B adjacent to each other attached to the first side 10 of the goods loading member 2, and the two third and fourth supports 6C and 6D adjacent to each other attached to the third side 12 are pushed in the outward direction as indicated by the arrow A in FIG. 2 or in the reverse direction so that each distance between the supports is made wider or narrower. In response to the pushing, the second joints 109 and 209 (FIG. 3), pivotally coupled to the lower end sides of the first and the second coupling members 14 and 15 located between the respective supports, slide upwardly or downwardly along the guide grooves of the supports 6. Accordingly, the first and the second coupling members 14 and 15 pivot about the pin 21 to extend or contract, thus the distance d1 between the first support 6A and the second support 6B and the distance d1 between the third support 6C and the fourth support 6D vary in substantial synchronization with each other.

When the distance between the second support 6B and the third support 6C and the distance between the fourth support 6D and the first support 6A are to be adjusted, the second and third supports 6B, 6C and the fourth and first supports 6D, 6A are pushed in the outward direction as indicated by the arrow B in FIG. 2 or in the reverse direction so that each distance between the supports is made wider or narrower. Accordingly, the second joints 109 and 209 (FIG. 3), pivotally coupled to the lower end sides of the second coupling members 14 and 15, slide upwardly or downwardly along the guide grooves of the supports. Accordingly, the first and the second coupling members 14 and 15 pivot about the pin 21, thus the distance d2 between the second support 6B and the third support 6C and the distance d2 between the first support 6A and the fourth support 6D vary in substantial synchronization with each other. The supports 6 with their adjusted distances are attached to the goods loading member 2 where the goods 1 are loaded in the same manner as the above case.

As explained above, the goods loading apparatus 3 according to this embodiment has the goods loading member 2 and the plurality of supports 6, and at the same time, the two adjacent supports 6 are coupled to each other so as to adjust the distance between the two supports by making the two adjacent supports closer to or apart from each other. Based on the structure, a plurality types of goods loading members 2, each of which has projections 7 with different distances D1 and D2 between them, are prepared. By selecting one of the prepared members, the distances d1 and d2 between the respective supports are adjusted according to the distances D1 and D2 between the respective projections 7 of the goods loading member 2, and then the supports can be attached to the goods loading member 2. The whole of the four supports 6 and the coupling members, which couple respective two adjacent supports to each other, constitutes an integrated support unit 32. When the support unit 32 is attached to the goods loading member 2, the supports 6 serve as a frame member to support the whole of the support unit 32.

Figure 5:
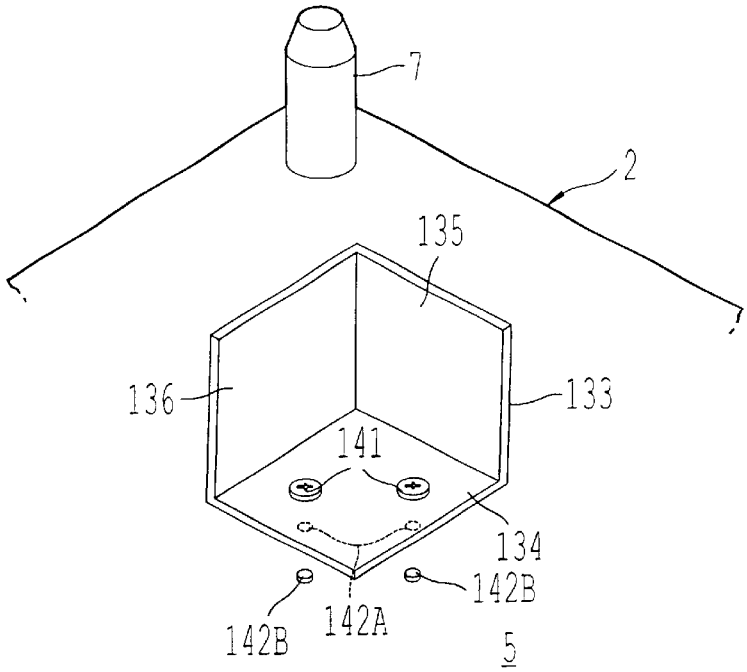
FIG. 5 shows a perspective view of a goods holding member fixed to the goods loading member.

The goods 1 loaded in the goods loading apparatus 3 are transported, stored, or exhibited as explained later. A goods holding unit is provided on the goods loading member 2 so that the goods 1 will not move with respect to the goods loading member 2 during transportation of the goods 1. The goods holding unit shown in FIG. 1 and FIG. 2 consists of two goods holding members 133 fixed to the top surface 5 of the goods loading member 2. The goods holding member 133, as shown in FIG. 5 where the member is enlarged, consists of a base 134 fixed to the top surface 5 of the goods loading member 2 and two stand panels 135 and 136 which are formed integrally to this base 134 and erected at substantially right angles to the base 134. Both of the stand panels 135 and 136 are positioned at an angle of almost 90° between the two panels, and the transverse cross-sectional shape of the stand panels 135 and 136 is a substantially L shape.

The goods 1 to be loaded on the top surface 5 of the goods loading member 2 are lowered from the upper side of the member to be loaded on the goods loading member 2. At this time, the bottom of the goods 1 is placed on the bases 134 of the goods holding members 133, and the external side of the lower part of the goods 1 is held by the stand panels 135 and 136 of the two goods holding members 133. The goods 1 thus loaded on the goods loading member 2 are held so as not to be moved in the horizontal direction. By lifting the goods 1, the goods 1 can be detached from the goods loading member 2 without being disturbed by the goods holding members 133.

Figure 6:
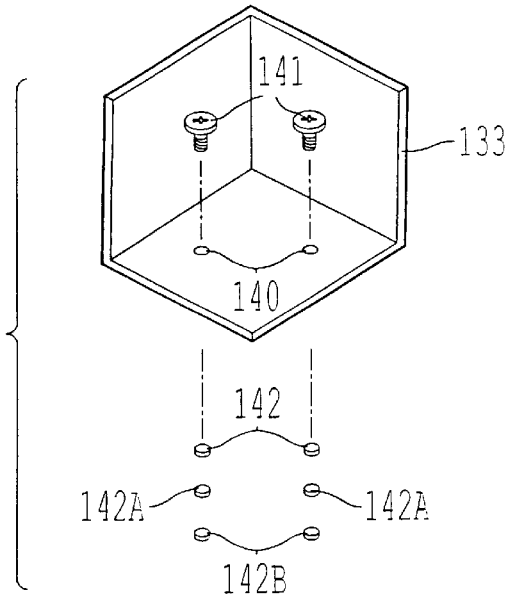
FIG. 6 shows a perspective view of the goods holding member separated from the goods loading member.

The goods 1 can be held stably on the goods loading member 2 in the manner explained above, and transported. In the example shown in FIG. 5, screws 141 are put into holes 140 formed on the base 134 of the goods holding member 133 as shown in FIG. 6, and by screwing the screws 141 into screw holes 142 formed on the goods loading member 2, the goods holding member 133 is fixed to the goods loading member 2. In that case, screw holes 142A and 142B other than the screw holes 142 are also formed. Therefore, when goods smaller than the goods 1 shown in FIG. 1 are to be loaded on the goods loading member 2, the screws 141 shown in FIG. 5 are unscrewed to free each of the goods holding members 133. The goods holding members 133 are then placed on the goods loading member 2 by setting the holes 140 shown in FIG. 6 on the other screw holes 142A or 142B, and the screws 141 are inserted into the holes 140 to be screwed into the screw holes 142A or 142B. Accordingly, the goods holding members 133 are fixed to the locations closer to each other as compared to the locations shown in FIG. 5. Thus, the goods matching the smaller size can be held on the goods loading member 2. Numbers of mounting holes (not shown) are previously formed on the goods loading member 2, and by selecting any of the mounting holes matching the size and the shape of goods 1 to be loaded on the goods loading member 2, putting bolts, not shown in the figure, into the mounting holes and the goods 1, screwing nuts into the bolts, and detachably securing the goods 1 to the goods loading member 2, the goods 1 can be held on the goods loading member 2. In this manner, the goods loading member 2 can hold goods of different sizes and shapes, that is, any of different types of goods.

Figure 7:
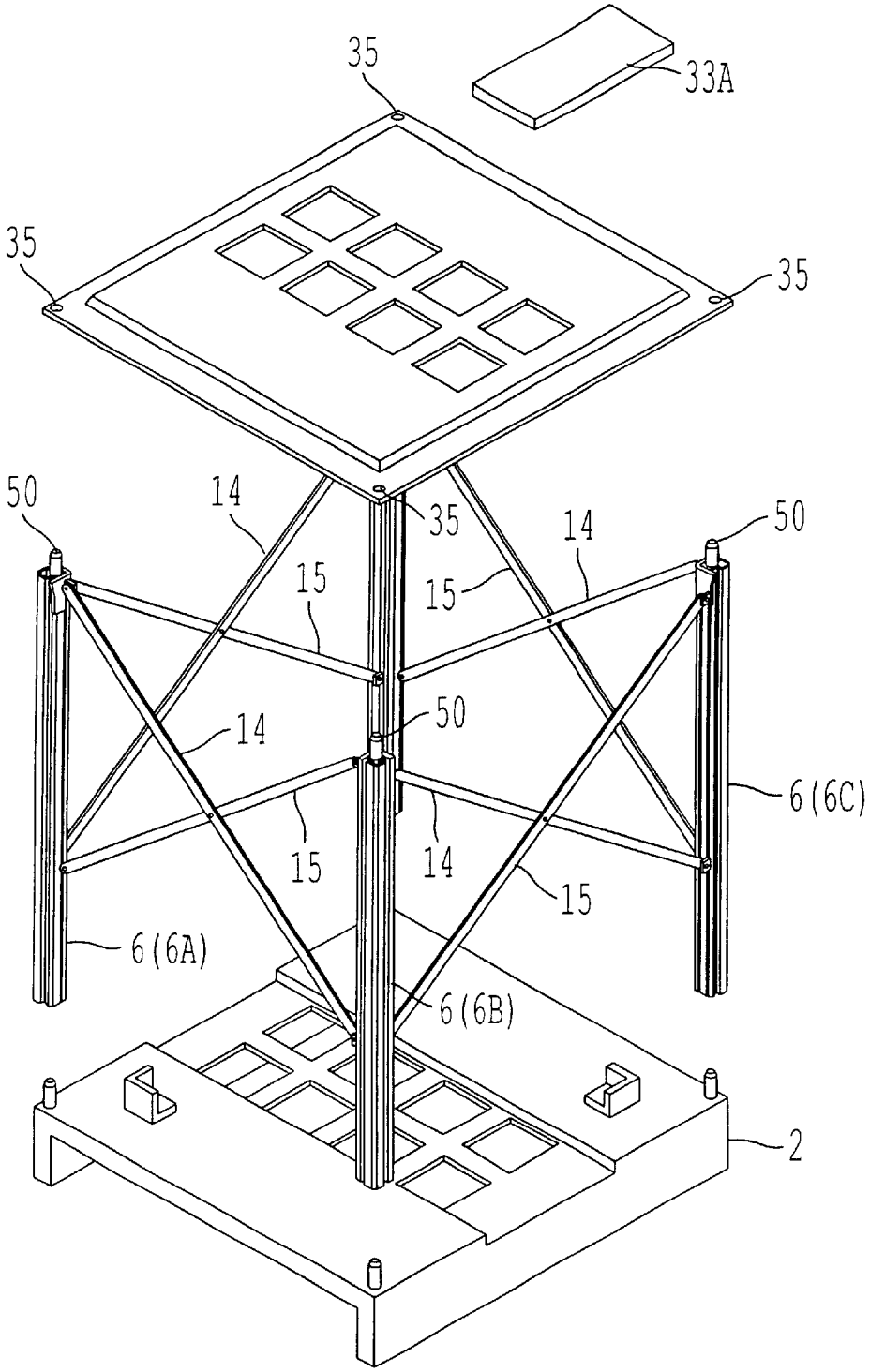
FIG. 7 shows a perspective view of the goods loading apparatus with a top.
Figure 8:
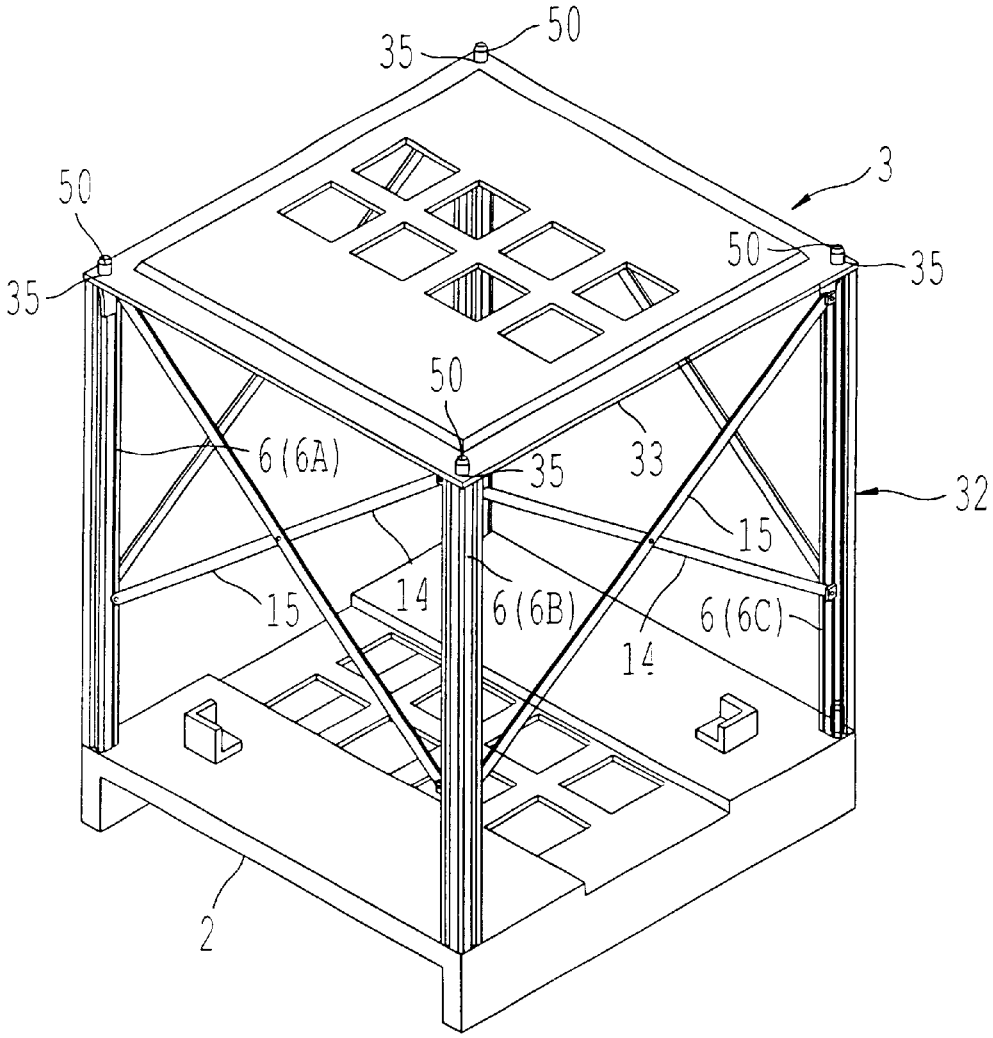
FIG. 8 shows a perspective view of the goods loading apparatus when the top is mounted on the upper ends of the supports.

As shown in FIG. 7 and FIG. 8, the top 33 can be also detachably attached to the upper end of the support 6. That is, mounting pins 50 are set to the upper ends of the supports 6, respectively, and mounting holes 35 formed in the top 33 are engaged with the mounting pins 50. In that case, other goods (not shown) can be loaded also on the top surface of this top 33.

Figure 9:
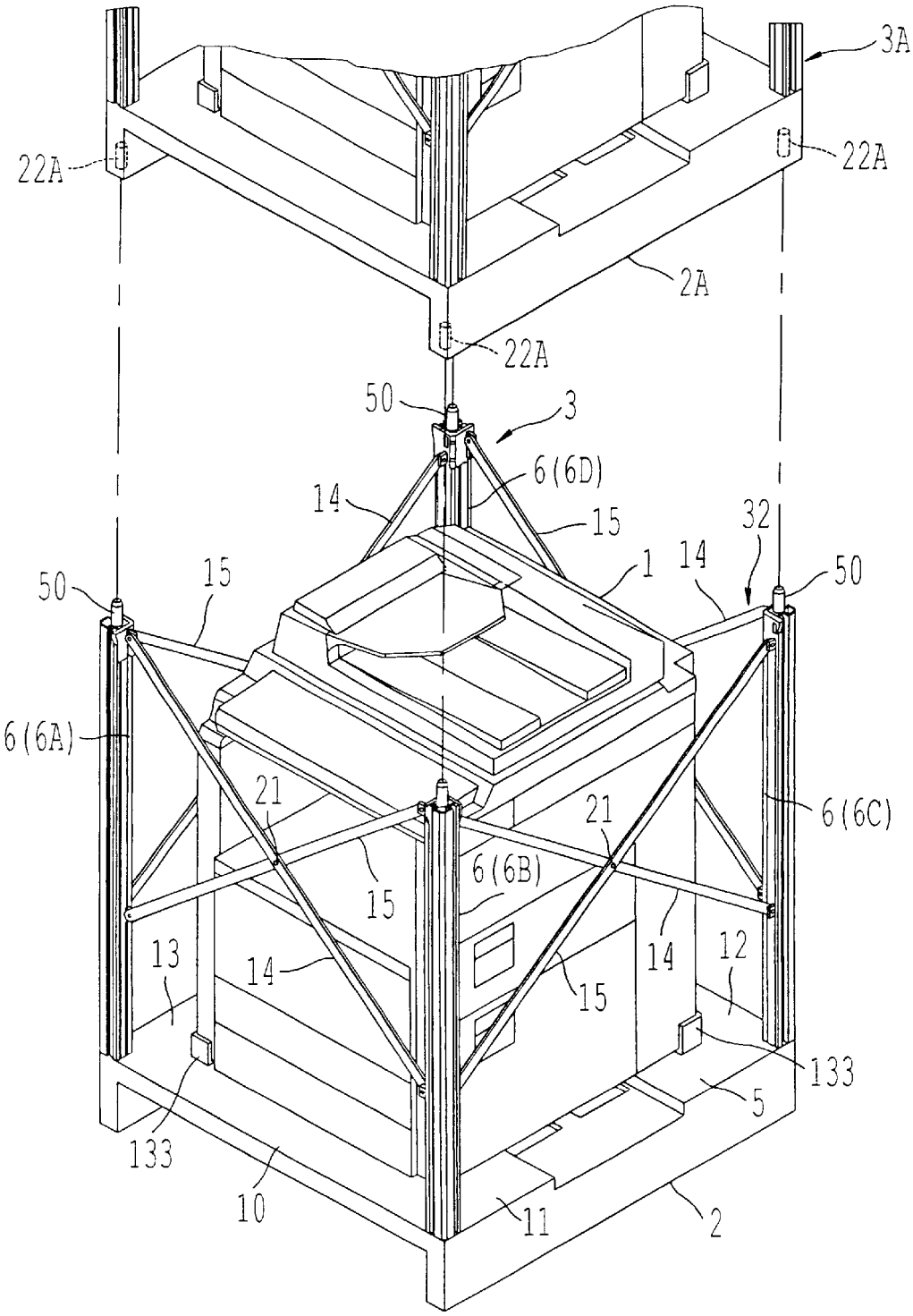
FIG. 9 shows a perspective view of how to load the upper-side goods loading apparatus on the lower-side goods loading apparatus.

Further, as shown in FIG. 9, another goods loading apparatus 3A, with a structure exactly the same as that of the goods loading apparatus 3, is lowered from the upper side of the goods loading apparatus 3 to load the goods loading apparatus 3A on the top of the lower-side goods loading apparatus 3. That is, a plurality of goods loading apparatuses 3 and 3A can be piled up. At that time, the mounting pins 50 set to the upper ends of the supports are fitted into mounting holes 22A formed in the goods loading member 2A of the upper-side goods loading apparatus 3A, so that both of the goods loading apparatuses 3 and 3A can be positioned.

As explained above, the provided top 33 where another goods can be loaded or a provided goods loading member 2A of another goods loading apparatus 3A can serve as a cover provided above the goods 1 loaded in the goods loading apparatus 3. Each of the top 33 and the goods loading member 2A forms an example of the second goods loading member provided above the goods 1.

Figure 10:
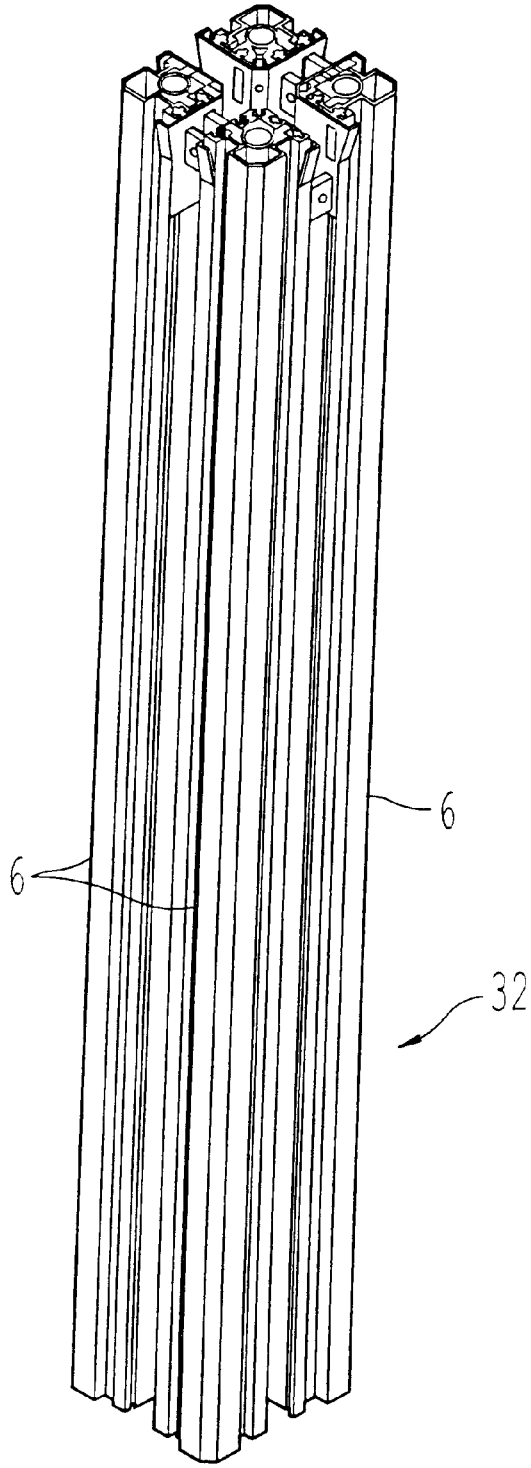
FIG. 10 shows a perspective view of the support unit in its folded state.

When the supports are detached from the pallet 2 and the four supports 6 held by hand are pushed in the direction so as to make them closer to each other, the second joints 109 and 209 attached to each of the supports 6 slide downwardly along the supports 6, and the first and second coupling members 14 and 15 provided between the respective supports pivot about the pin 21 to be folded up, so that the whole of the support unit 32 can be folded to be compact as shown in FIG. 10. As explained above, the goods loading apparatus 3 according to this embodiment is structured so that the plurality of supports 6 detached from the goods loading member 2 can be made close to each other, keeping their substantially parallel state, and can be folded up.

The supports 6 or the coupling members 14 and 15 for coupling adjacent supports to each other are extendable so as to extend or contract distances between the supports in the manner as the above case. Further, the support unit 32 can be disassembled to a plurality of members. That is, the screws 59 shown in FIG. 3 are unscrewed to free the fixing member 56 from the support 6, and the first joints 108 and 208 are slid along the guide grooves 54 and 55 to detach these joints 108 and 208 from the upper end or the lower end of the support 6 (see FIG. 4). The second joints 109 and 209 can be detached from the support 6 in the same manner as the above case. As explained above, the supports 6 or the supports 6 and the coupling members 14 and 15 can be deformed according to a variety of shapes.

Figure 11:
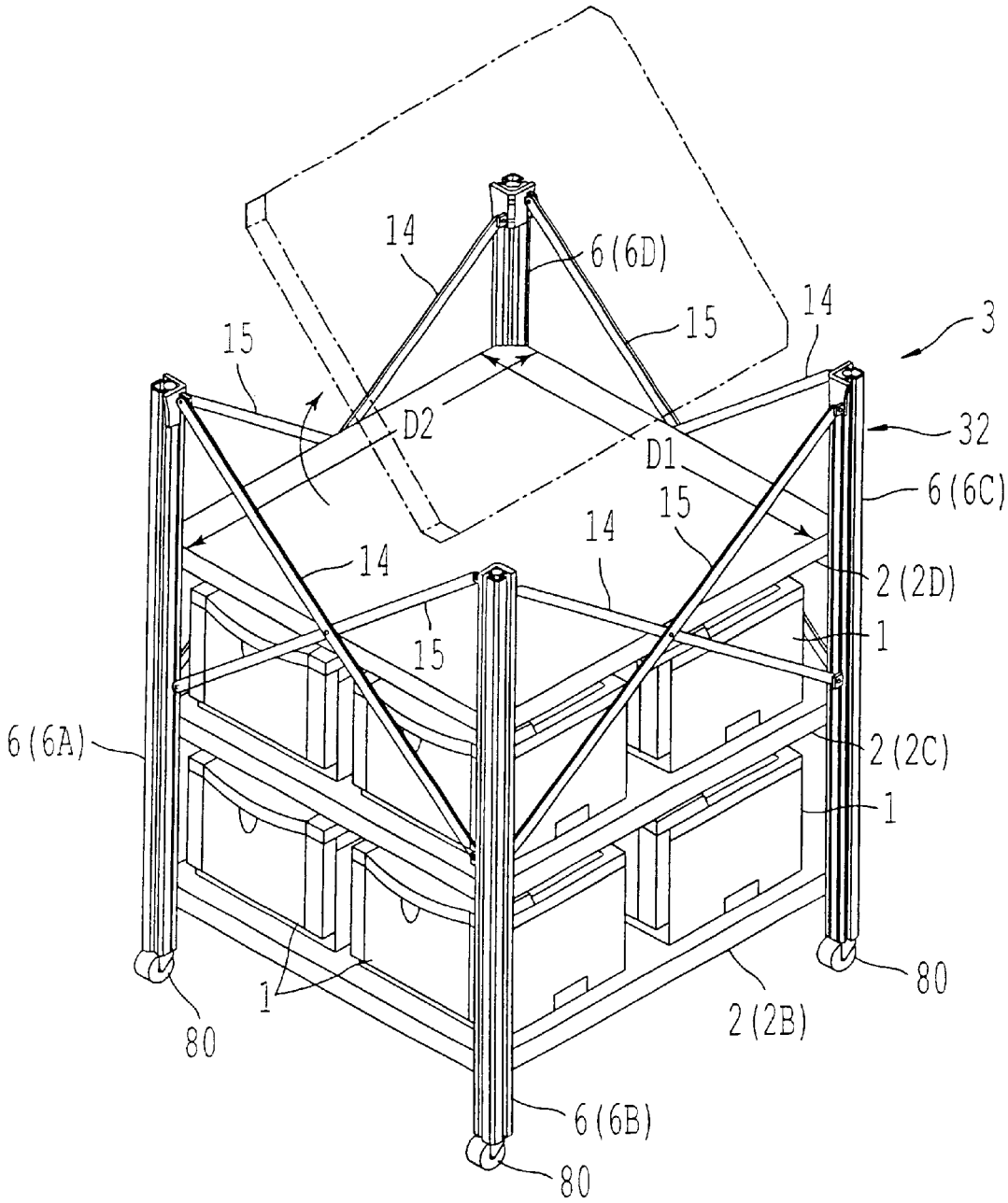
FIG. 11 shows a perspective view of the goods loading apparatus with a goods loading member formed as a table plate.

Although the goods loading member 2 of the goods loading apparatus 3 as explained above is structured as a pallet to which the lower ends of the supports can be attached, the goods loading member may be structured as a table plate. FIG. 11 shows the goods loading apparatus 3 in which the goods loading member 2 structured as a table plate is detachably attached to and supported by the supports 6 of the support unit 32 structured in the same manner as the support unit shown in FIG. 2. Although at least one unit of the goods loading member 2 is required, FIG. 11 shows a state where three goods loading members 2 are attached to the supports 6. Reference signs 2B, 2C, and 2D are assigned to the respective goods loading members so that these goods loading members are discriminated from one another as required. As shown in FIG. 11, a plurality of goods 1, which are printers, are loaded on the goods loading members 2B, 2C, and 2D.

There are also prepared the goods loading members 2 of various sizes corresponding to the size, the shape, or the quantity of the goods 1, therefore, one of the goods loading members 2 suitable for the size, the shape, or the quantity of the goods 1 is selected, and the selected goods loading member is attached to the supports 6. In this case, lengths D1 and D2 of the sides of a goods loading member 2 may be different depending on the size of the selected one. However, the distances between the supports 6 can be adjusted as explained above so as to correspond to the lengths D1 and D2. The selected goods loading member 2 is then attached to the supports 6 with a load-plate holding unit as explained below.

Figure 12:
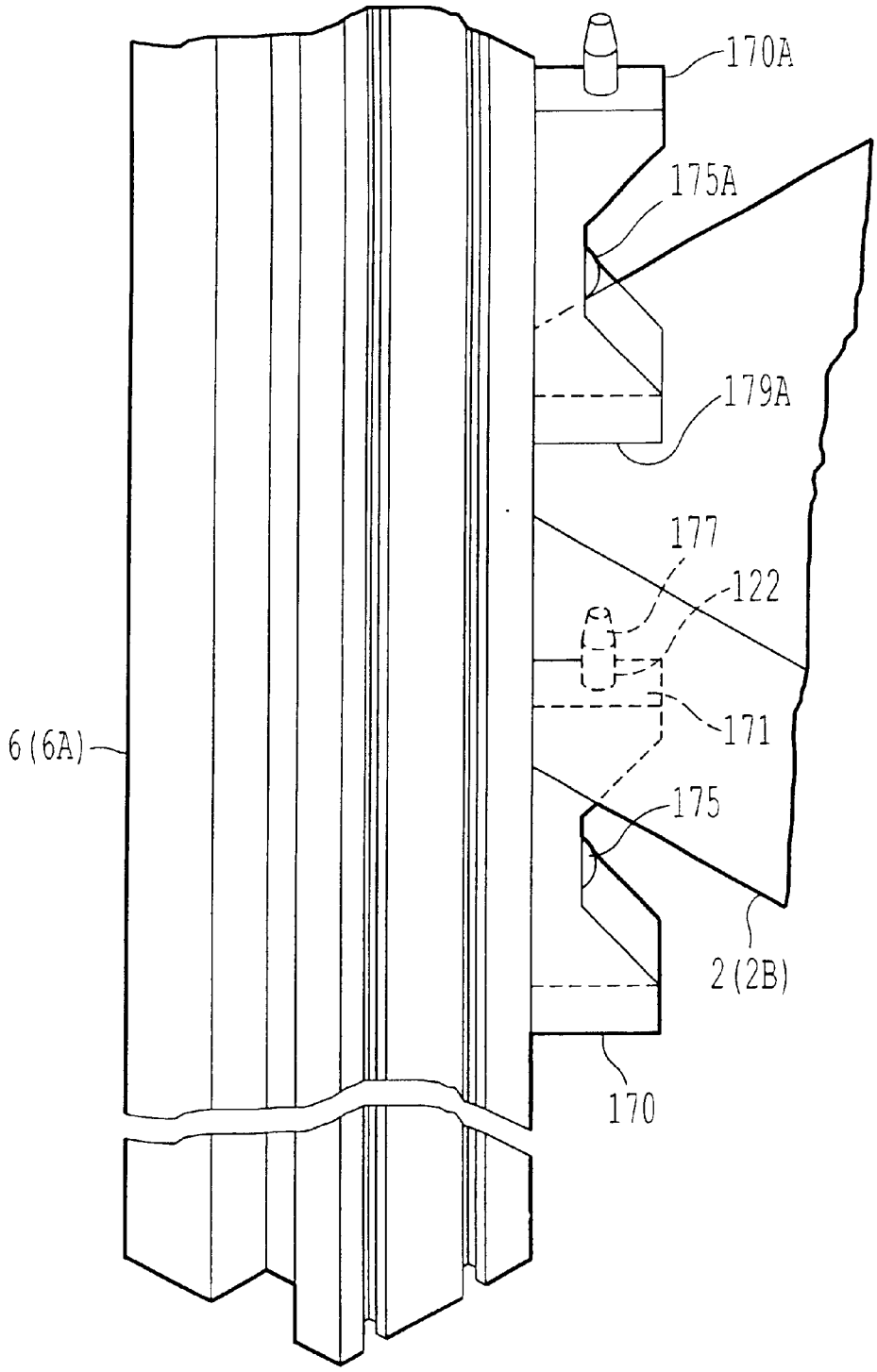
FIG. 12 shows a perspective view of an example of the structure to fix the goods loading member to the supports.
Figure 13:
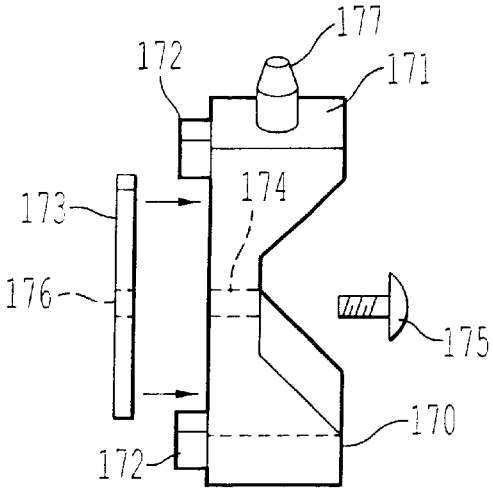
FIG. 13 shows a perspective view of a plate supporting member.

The load-plate holding unit has plate supporting members, that hold corners of the goods loading member 2 to the supports 6, and plate retaining members (not shown in FIG. 11). FIG. 12 shows an example of a plate supporting member 170 and a plate retaining member 170A with which the corner of the goods loading member 2B is attached to the first support 6A. FIG. 12 is an enlarged perspective view of the first support 6A when viewed from the same direction as that shown in FIG. 11. The plate supporting member 170 shown here is formed in a small block having a flat top surface 171 as shown in FIG. 13. A pair of upper and lower projections 172 which are slidably and detachably fitted into the groove 57 (see FIG. 3) made on the support 6A are formed on one side of the plate supporting member 170. A nut 173 as shown in FIG. 13 is slidably fitted into the groove 57 of the support 6A in its longitudinal direction. This nut 173 is also inserted into the groove 57 of the support 6A from its upper end or lower end, so that the nut 173 will not be detached in the radius direction of the support 6A.

The two projections 172 of the plate supporting member 170 are fitted into the groove 57, and the nut 173 fitted into the groove 57 is positioned between the upper and lower projections 172 as shown in FIG. 13, they are thus arranged. The screw 175 is then inserted into a hole 174 made in the plate supporting member 170, and is screwed into a screw hole 176 of the nut 173 to tighten the screw 175. Accordingly, the plate supporting member 170 is detachably secured to the support 6A. A plate supporting member with a structure exactly the same as that of the plate supporting member 170 shown in FIG. 13 is detachably secured to each of the second to the fourth supports 6B, 6C, and 6D in the same manner as the above case. At that time, the four plate supporting members 170 are attached to the supports 6 so that top surfaces 171 of the members keep almost the same level as one another.

The corners of the selected goods loading member 2B are placed, as shown in FIG. 12, on the top surfaces 171 of the plate supporting members 170. The goods loading member 2B is thus supported by the four plate supporting members 170 from its lower side. Accordingly, the goods loading member 2B is disposed in an internal space formed with the plurality of supports 6. At this time, locating pins 177 provided upwardly on the top surfaces 171 of the plate supporting members 170 are fitted into locating holes 122 made in the underside of the goods loading member 2B. Accordingly, the goods loading member 2B is correctly positioned in the horizontal direction with respect to the supports 6.

On the other hand, the plate retaining member 170A shown in FIG. 12 has a structure exactly the same as that of the plate supporting member 170 and is also attached to the support 6A in the same manner as the plate supporting member 170. That is, the plate retaining member 170A is detachably secured to the support 6A by the nut (not shown) fled into the groove 57 and a screw 175A, with the underside 179A of the member 170A touching the top surface of the goods loading member 2B supported by the plate supporting member 170. Plate retaining members 170A are detachably secured to the other supports 6B, 6C, and 6D in the same manner as the above case. The plate supporting member 170 and the plate retaining member 170A are formed with a material such as metal, resin, wood, or rubber.

By thus securing the plate retaining members 170A to the supports 6, the top surface of the goods loading member 2B is pressed by the plate retaining members 170A, that is, the goods loading member 2B is held by the plate retaining members 170A and the plate supporting members 170 from its upper and lower sides, and is supported by the supports 6 without its disengagement from the supports 6.

After the goods loading member 2B is attached to the supports 6, as shown in FIG. 11, the goods loading member 2C above the goods loading member 2B is also attached to the supports 6 via the plate retaining members and plate supporting members in exactly the same manner as the case of the goods loading member 2B. Further, in a like manner, the upper-side goods loading member 2D is attached to the supports 6. Even when there are four or more of goods loading members, the members can successively be attached to the supports 6 from the lowest one.

The goods 1 are loaded on the goods loading members 2B and 2C thus attached to the supports 6 as shown in FIG. 11. In the example shown in FIG. 11, although the highest goods loading member 2D serves as a top of the goods loading apparatus 3, goods not shown may also be loaded on this goods loading member 2D. In that case, the goods loading members 2 are attached to the supports 6, and goods 1 may be loaded on each top of the members. Alternatively, the lowest goods loading member 2B may first be attached to the supports 6 to load the member 2B with goods 1, the goods loading member 2C above the member 2B may be attached to the supports 6 to load the goods loading member 2C with goods 1, and then the highest goods loading member 2D may be attached to the supports 6 to load the member 2D with goods 1. The goods 1 on each of the goods loading members 2 can also be held by being fixed with goods holding members 133 (FIG. 1, FIG. 5, and FIG. 6) position-adjustably fixed on the goods loading member 2, although it is not shown in FIG. 11. Further, casters 80 are fixed to the lower ends of the supports 6 as shown in FIG. 11, so that the support unit 32 can easily move along the floor.

The size of the goods loading member 2 shown in FIG. 1 and FIG. 11 and the top 33 shown in FIG. 7 and FIG. 8, that is, each external shape of these two can also be enlarged or contracted. Based on such a structure, the size of the goods loading member 2 and the top 33 can be altered using one unit of goods loading member 2 and one unit of top 33 according to the size, the shape, or the quantity of goods 1 to be loaded on the goods loading member 2, and distances between the supports can be adjusted according to the alteration. Therefore, one unit of goods loading apparatus 3 can manage to transport or store various types of goods 1. Likewise, a support may be structured so as to be extendable and enable adjustment of the length of each support according to the height of goods to be transported. For example, the support is formed with a plurality of telescoping support members, the length of the support members is adjusted, and then the support members are fixed to each other by fixing units such as screws.

As understood from the above explanation, the top 33 (FIG. 7, FIG. 8) where another goods are able to be loaded can be disposed above goods 1 loaded on the goods loading member 2 of the goods loading apparatus 3. Another goods loading apparatus 3A (FIG. 9) is loaded on the goods loading apparatus 3, so that the goods loading member 2A of the goods loading apparatus 3A can also be disposed above the goods 1 loaded in the goods loading apparatus 3. Further, as shown in FIG. 11, another goods loading member 2C is disposed above the goods 1 on the goods loading member 2B, and a goods loading member 2D where another goods can be loaded may be disposed above the goods on the goods loading member 2C. In that case, the top 33 and the goods loading members 2A, 2C, and 2D constitute a second goods loading member which is located above the goods 1 loaded in the goods loading apparatus 3.

By putting together the supports 6 and the goods loading member 2, the goods loading apparatus 3 assembled as shown in FIG. 1, FIG. 8, and FIG. 11 is formed. At this time, the goods 1 on the goods loading member can be accommodated in a storage space surrounded by the plurality of supports 6 and the coupling members 14 and 15. The method for handling goods according to this embodiment is provided for loading goods 1 into such a goods loading apparatus 3, and transporting, storing, or exhibiting the goods 1.

For example, a fork of a forklift as a cargo gear is inserted into the underside of the goods loading member 2 (the lowest goods loading member 2B in the example of FIG. 11) of the goods loading apparatus 3 as shown in FIG. 1, FIG. 8, and FIG. 11, and by raising the fork, the goods loading apparatus 3 is lifted. Thus the goods 1 are transported. The goods loading apparatus 3, with the goods 1 remaining loaded, is transferred to a truck, a ship, or a rail car to enable transportation of the apparatus 3. Further, the goods 1 accommodated in the goods loading apparatus 3 can also be stored in a warehouse or the like. The goods 1 loaded in the goods loading apparatus 3 can also be exhibited at a store, for example. The goods loading apparatuses 3 and 3A piled up in a plurality of stages as shown in FIG. 9 can also be transported, stored, or exhibited. In that case, all directions around the goods 1 are surrounded by the supports 6 and the coupling members 14 and 15, which allows the goods 1 to be protected.

More specifically, a goods loading apparatus 3 where goods 1 are loaded is transported from a manufacturing plant for copying machines, as an example of goods to be carried, to a user, where the four supports 6 are detached from a goods loading member 2, and the goods are then unloaded from the goods loading member 2. By taking the empty goods loading apparatus 3 back to the manufacturing plant, goods can be loaded again into the goods loading apparatus 3 to be transported. When the empty goods loading apparatus 3 is to be sent back to the plant, the support unit 32 detached from the goods loading member 2 is folded up as shown in FIG. 10, thus the transporting operation can efficiently be performed.

By loading goods 1 into the goods loading apparatus 3 and transporting, storing, or exhibiting the goods 1 in the manner above, goods 1 of any size, shape, or quantity can efficiently be transported, stored, or exhibited by adjusting the goods loading apparatus 3 to any size suitable for the goods. That is because distances between the supports of the goods loading apparatus 3 can be adjusted according to the size, the shape, or the quantity of the goods 1 to be handled. If any goods loading apparatus much larger than the size of goods to be handled is used, the goods loading apparatus becomes unnecessarily bulky, which causes the space where the goods loading apparatus is placed to be wasted. However, by using the goods loading apparatus 3 according to this embodiment, such inconvenience can be prevented. By contracting the goods loading apparatus 3 in a case of small goods or enlarging the goods loading apparatus 3 in a case of large goods, any goods can efficiently be handled.

When the goods 1 are loaded into the goods loading apparatus 3, a plurality of supports 6 are located around the goods 1 and the coupling members 14 and 15, that couple the supports to each other, also surround the goods 1 in the example shown in the figure, so that the goods 1 on the goods loading member 2 can be protected by these supports and members. The supports 6 or the supports 6 and the coupling members 14 and 15 form an example of a protective member that protects the goods 1. The goods 1 can also be protected only by the supports 6.

As explained above, in the method for handling goods according to this embodiment, goods 1 are transported, stored, or exhibited using the goods loading member 2 where goods 1 are loaded and the protective member that protects the goods 1 on the goods loading member 2. Therefore, inconvenience such that the goods 1 may be scratched or damaged during handling of the goods 1 can be prevented.

In that case, as explained above, the goods loading member 2 is structured so as to be able to hold any of different types of goods by providing a plurality of goods holding members 133 (FIG. 1, FIG. 5, FIG. 6), whose locations to be fixed are adjustable, on the top surface of the goods loading member 2. Accordingly, a variety of goods of different sizes, shapes, or quantities can efficiently be transported, stored, or exhibited.

Further, a second goods loading member comprising the top 33, the goods loading member 2A of the upper-side goods loading apparatus 3A, or the highest goods loading member 2D formed as a table plate is provided above the goods 1 on the goods loading member 2. When the goods 1 in this state are then transported, stored, or exhibited, the goods 1 can be protected more securely by the second goods loading member provided above the goods 1 on the goods loading member 2. Further, by loading another goods on the second goods loading member, the goods can efficiently be handled.

As shown in FIG. 9, for example, another goods loading apparatus 3A is put on the goods loading apparatus 3. In this case, the second goods loading member 2 consisting of the goods loading member 2A of the upper-side goods loading apparatus 3A, and a second protective member of the member 2A, for example, the supports or the supports and the coupling members of the goods loading apparatus 3A are provided above the goods 1 loaded on the goods loading member 2 of the lower-side goods loading apparatus 3. The goods 1 in the goods loading apparatus 3 can also be transported, stored, or exhibited in that state. According to the method for handing goods, the second goods loading member is located above the goods 1 loaded in the goods loading apparatus 3, therefore, goods can efficiently be handled while the goods 1 can be protected more securely and the goods on the second goods loading member can also be protected by the second protective member.

When the top 33 is mounted on the upper ends of the supports 6, or another goods loading apparatus 3A is loaded on the upper ends of the supports 6, or the highest goods loading member 2D is supported by the supports 6, the supports 6 of the goods loading apparatus 3 are used as a supporting member that supports the top 33, the upper-side goods loading apparatus 3A, or the highest goods loading member 2D. While the top 33, the upper-side goods loading apparatus 3A, or the highest goods loading member 2D forms an example of a supported member supported by the supporting member.

As explained above, the supported member in this embodiment is a cover provided above goods on the goods loading member 2. This supported member maybe another goods loading member such as the top 33 or the goods loading members 2A, 2D where goods can be loaded. Further, the supported member may be the goods loading member 2A of the second goods loading apparatus 3A, that is, the second goods loading member, located above the goods 1 on the goods loading member 2, and the supports of the second goods loading apparatus 3A, that is, the second supporting member.

As explained above, goods can also be transported, stored, or exhibited by using the goods loading member 2 where the goods 1 are loaded, the supporting member attachable to the goods loading member 2, and the supported member that is supported by the supporting member. The goods can be efficiently handled by using the method for handling goods as well.

The supports 6, or the supports 6 and the coupling members 14 and 15 form an example of a protective member as explained above. Although the supports 6 form an example of the supporting member, the protective member or the supporting member can be disassembled to a plurality of members or structured so as to be extendable, that is, the member can be deformed as explained above. According to the method for handling goods using the protective member or the supporting member, by extending or contracting the protective member or the supporting member, various types of goods can efficiently be handled. In addition, when the degraded protective member or supporting member is to be disposed of, the member can easily be disassembled.

As is apparent from the above explanation, the protective member or the supporting member is formed with a reusable member, for example, at least one of materials of metal, resin, and wood. According to the method handling goods using such a protective member or supporting member, the goods loading apparatus 3 can be used many times. When the conventional corrugated-cardboard box is used for accommodating and transporting goods, the corrugated-cardboard box is in many cases disposed of at a destination for transportation, which causes a large mount of disposal to be generated. However, according to the method for handling goods of this embodiment, it is possible to eliminate the disposal or to reduce an amount of the disposal to an extremely small amount.

When goods are handled in the following manner using the goods loading apparatus 3 which can be formed in any of various shapes as explained above, the efficiency of transporting goods can particularly be increased.

Figure 14:
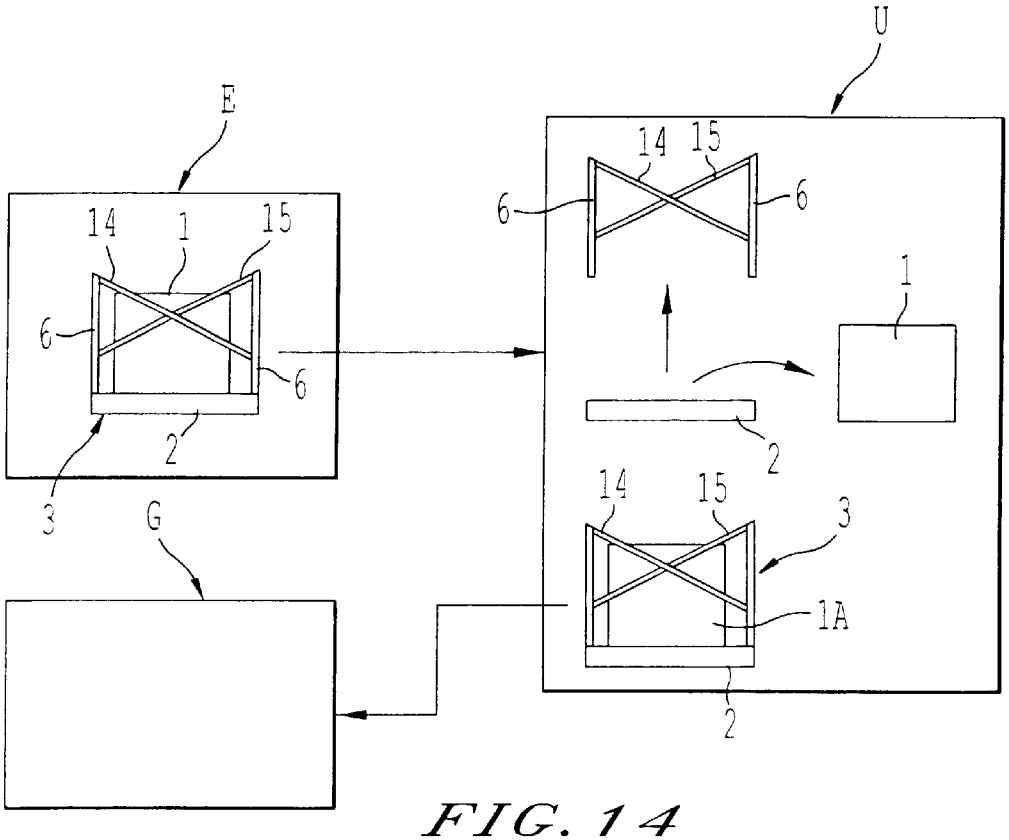
FIG. 14 shows a method for handling goods in which trade-in goods are loaded in the goods loading apparatus and transported.

FIG. 14 schematically shows a process how to load the goods loading apparatus 3 with goods 1 consisting of a copying machine and transport the goods from a copying-machine manufacturing plant E (which may be a warehouse or a distributor) to a user U including an individual or a corporation. The process is as follows: a space between supports of a goods loading apparatus 3 is adjusted according to the size and the shape of goods 1 at the manufacturing plant E. The goods 1 are loaded into the goods loading apparatus 3 and transported to the user U by transportation such as a truck. At the destination, the supports 6 and the coupling members 14 and 15 are detached from a goods loading member 2 of the goods loading apparatus 3, and the goods 1 are unloaded from the goods loading member 2. At this time, trade-in goods 1A, for example, a used copying machine that has been used thus far by the user may be traded in with or without charge from the user. In this case, the trade-in goods 1A are loaded into the empty goods loading apparatus 3, and the goods are transported by transportation such as a truck to another site such as a recycling dealer G.

As explained above, it is possible to load goods 1 into the goods loading apparatus 3 and transport the goods 1 to a specified site such as a user, unload the goods 1 from the goods loading apparatus 3 at the site, load trade-in goods 1A into the goods loading apparatus 3, and transport the trade-in goods to another site. According to the method for handling goods, the goods loading apparatus 3 remaining empty is no longer sent back, thus the goods 1 and 1A can be transported with high efficiency.

In the method, at the time of loading trade-in goods 1A into the goods loading apparatus 3 at the user U, if the trade-in goods 1A are the same size as the new goods 1 having been transported to the user U, the trade-in goods 1A can be loaded in the goods loading apparatus 3 as they are without necessity of re-adjusting the shape of the goods loading apparatus 3. However, the size, the shape, or the quantity may be different between the goods 1 and 1A.

For such cases, some pieces of goods loading member 2 of different sizes and some pieces of top of different sizes, if necessary, are prepared other than the goods loading apparatus 3 where goods 1 are loaded at the time of leaving the manufacturing plant E, and transported to the user U. A goods loading member 2 matching the size of the trade-in goods 1A is selected there, a space between the supports is adjusted to fit the size of the goods loading member 2, the adjusted supports are attached to the selected goods loading member 2 to assemble the goods loading apparatus 3, and then the trade-in goods 1A loaded in the goods loading apparatus 3 is transported to another sites such as a recycling dealer G. By thus doing, trade-in goods 1A of any sizes can be transported, and further, the goods loading apparatus 3 is not allowed to be bulky more than necessary at the time of transporting the trade-in goods 1A. Thus, the trade-in goods 1A can efficiently be transported.

It is required to transport the goods loading members and the tops in addition to the goods loading apparatus 3 from the manufacturing plant E to the user U. However, by piling up the goods loading members and the tops, they can extremely be compacted, which allows them to easily be transported.

Alternatively, as explained above, by using the goods loading member 2 and the top 33, external shapes of which can be enlarged or contracted, only the goods loading apparatus 3 where goods 1 are loaded is transported from the manufacturing plant E to the user U, where the goods 1 are unloaded. Each size of the goods loading apparatus 3 and the top 33 is adjusted according to the size of trade-in goods 1A, a space between supports is adjusted according to the size, and the trade-in goods 1A can be transported. By thus doing, the new goods 1 and the trade-in goods 1A can effectively be transported, respectively, by only one goods loading apparatus 3.

As in the conventional case, when goods are accommodated in a corrugated-cardboard box to be transported to a user, if any goods traded-in from the user do not fit the size of the corrugated-cardboard box, the trade-in goods can not be transported using the corrugated-cardboard box. On the contrary, according to the method for handling goods as explained above, the inconvenience having occurred due to usage of the corrugated-cardboard box will never occur. Because this method is performed by loading goods 1 into the goods loading apparatus 3 to transport them, unloading the goods 1 from the goods loading apparatus 3, adjusting a space between supports according to the size, the shape, and the quantity of trade-in goods to be attached to a goods loading apparatus 3, loading this goods loading apparatus 3 with the trade-in goods, and transporting the trade-in goods to another site.

There is a user having used a printer, a facsimile, and a copier. When the user purchases a multifunction machine combining all of the three functions instead of these machines, goods traded-in from the user, that is, the quantity of machines such as the printer, the facsimile, and the copier may be larger than the quantity of goods 1 (i.e., multifunction machine) transported from a manufacturing plant. In this case, a large number of trade-in goods can also be efficiently transported by adjusting a space between supports according to the quantity of the trade-in goods.

Likewise, there is sometimes a case where goods 1, for example, a refrigerator is transported to a user U and completely different types of goods from the refrigerator such as a television or a radio are traded in other than the trade-in refrigerator. In this case, by adjusting a space between supports of a goods loading apparatus 3 according to the shape and the quantity of the different types of trade-in goods, the trade-in goods can be loaded into the goods loading apparatus 3, and transported to another site as well.

Figure 15A:
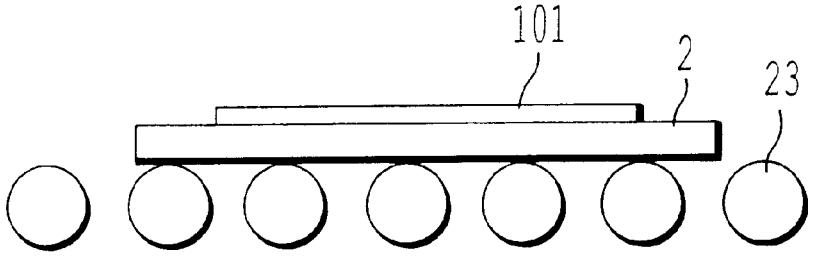
FIG. 15A and FIG. 15B show a method for handling goods in which the goods loading member is used as a conveying tool when the goods are manufactured.
Figure 15B:
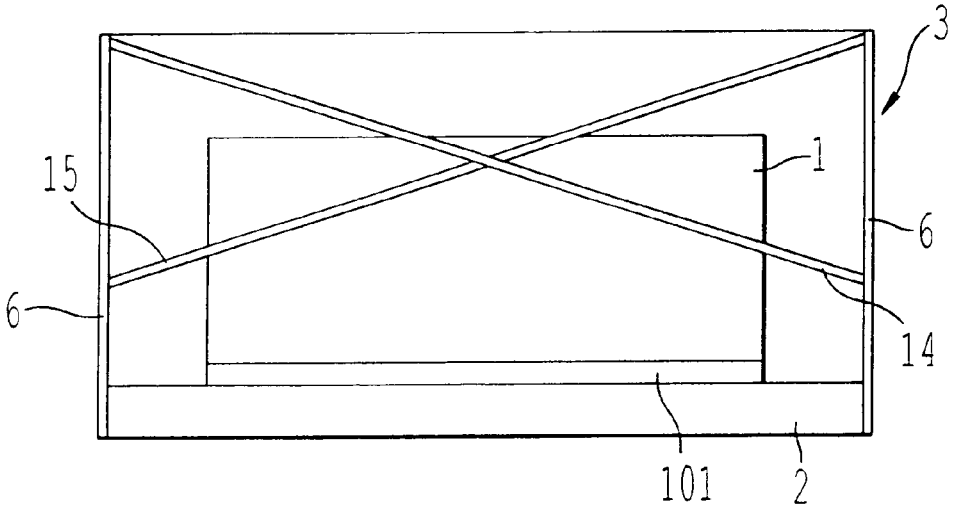

Further, the goods loading member 2 of the goods loading apparatus 3 can be used as a conveying tool during manufacturing of goods 1. For example, as shown in FIG. 15A, in a manufacturing plant or a machining plant of copying machines, the goods loading member 2 is loaded on a roller conveyor 23, and during conveying of the member in the direction indicated by the arrow, a base member 101 of a copying machine is fixed to the goods loading member 2, and a frame of the copying machine, various types of units or some other components are successively mounted on the base member 101 to assemble the copying machine, or the copying machine is machined. The finished copying machine remains fixed to the goods loading member 2, and when the copying machine is shipped, for example, as shown in FIG. 15B, supports 6 whose space is adjusted according to its size are attached to the goods loading member 2 together with coupling members 14 and 15 to assemble the goods loading apparatus 3, and this apparatus is transported to another site as it is.

As explained above, at the time of manufacturing goods 1, the goods 1 are manufactured on a goods loading member 2, and a plurality of supports 6 in which a space between two adjacent supports are adjustable can be attached to the goods loading member 2 by the time the goods 1 are shipped.

According to the method for handling goods, the goods loading member 2 can be used as a conveying tool for goods during manufacturing. In addition, the supports 6 are attached to the goods loading member 2 to form a goods loading apparatus 3 with goods 1 loaded, and this goods loading apparatus 3 can be transported. Thus, the manufacturing efficiency and the transporting efficiency of goods can be increased.

Figure 16:
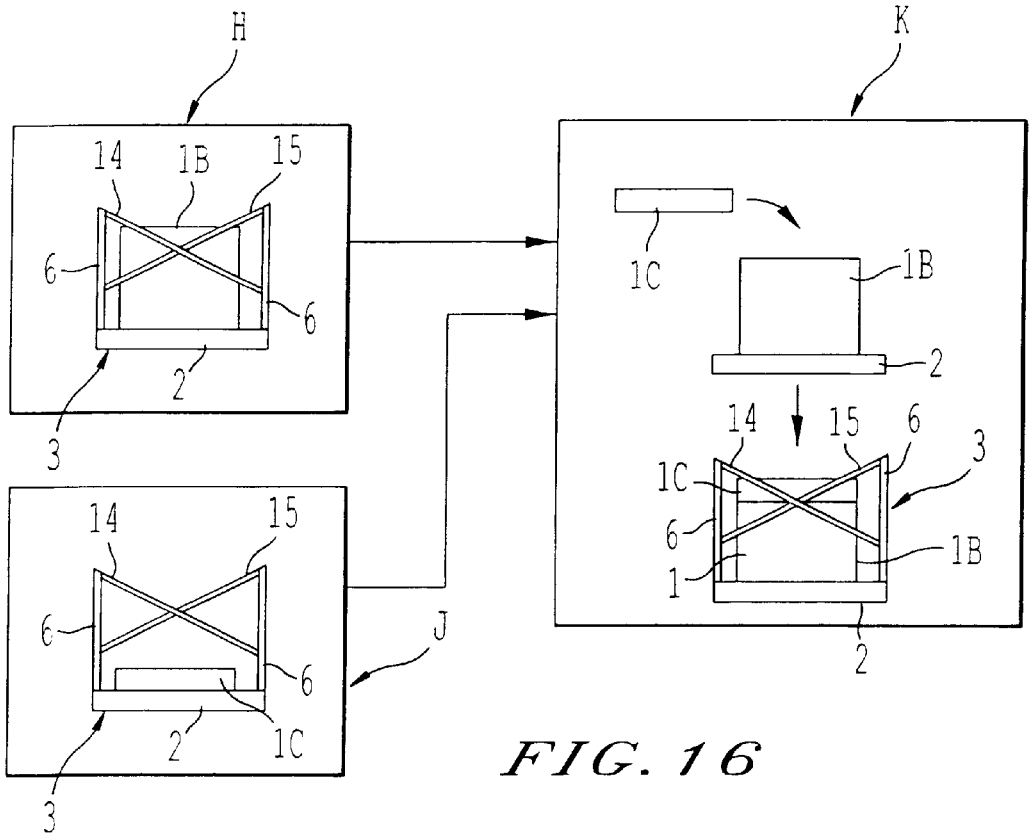
FIG. 16 shows a method for handling goods in which goods manufactured at different sites are put together at an assembly site.

By the way, it is conceivable to use a goods transporting system as shown in FIG. 16 explained below. In this system, at a first site H, for example, at a manufacturing plant in Tokyo, the main body 1B of a copying machine is manufactured while, at a second site J, for example, at a manufacturing plant in Yokohama, a device to be mounted on the main body 1B of the copying machine such as an auto document feeder 1C is manufactured. The main body 1B of the copying machine and the auto document feeder 1C are transported to an assembly site K as a third site such as a manufacturing plant, a machining plant, a distributor, or a warehouse at overseas or at home. The main body 1B of the copying machine and the auto document feeder 1C are put together at any of the sites, and the goods 1 consisting of the finished copying machine are transported to a user, for example. In this case, by handling the respective goods using the goods loading apparatus 3, the whole process can extremely efficiently be carried out.

At the first site H, for example, goods consisting of the main body 1B of the copying machine are loaded into the goods loading apparatus 3, while, at the second site J, goods consisting of the auto document feeder 1C are loaded into the goods loading apparatus 3. These apparatuses are then transported to the assembly site K. At this site, the auto document feeder 1C is unloaded from the goods loading apparatus 3, while the main body 1B of the copying machine is not unloaded from the goods loading apparatus 3, but the supports 6 and the coupling members are detached from the goods loading member 2. Subsequently, the auto document feeder 1C is mounted on this main body 1B of the copying machine to construct the whole of the copying machine. The supports 6 and the coupling members 14 and 15 are then attached to the goods loading member 2 where the finished copying machine is loaded to assemble the goods loading apparatus 3, and the finished copying machine in this goods loading apparatus 3 is transported in that state to the user, for example. In this example, two goods: the main body 1B of the copying machine and the auto document feeder 1C are transported to the assembly site to put these devices together. However, goods are transported to a goods assembly site from three or more of different sites, one of the goods remains loaded in the goods loading apparatus 3, and the other two or more of goods may be mounted on the goods.

The bottom line is as follows. Respective goods to be mounted are loaded on a plurality of goods loading apparatuses 3 at different sites H, J, and the respective goods are transported to an assembly site K. At the assembly site K, the goods loaded on one of the goods loading apparatuses 3 is not unloaded from the goods loading member 2, but supports 6 of the relevant goods loading apparatus 3 are detached from the goods loading member 2. The goods unloaded from the other goods loading apparatus 3 is then mounted to the goods on the relevant goods loading member 2. The supports 6 are again attached to the goods loading member 2 where the assembled goods are loaded, and the goods loaded on the relevant goods loading apparatus 3 are transported to another site.

According to this method for handling goods, the goods loading apparatus 3 is used as a transporting tool to transport the main body 1B of the copying machine and the auto document feeder 1C to an assembly site. After the main body 1B of the copying machine and the auto document feeder 1C are put together, the identical goods loading apparatus 3 can be used as a transporting tool to transport the goods to another site, which allows the respective goods to be extremely efficiently handled. Further, since there is no need to unload the main body 1B of the copying machine from the goods loading member 2, the work can easily be carried out.

Figure 17:
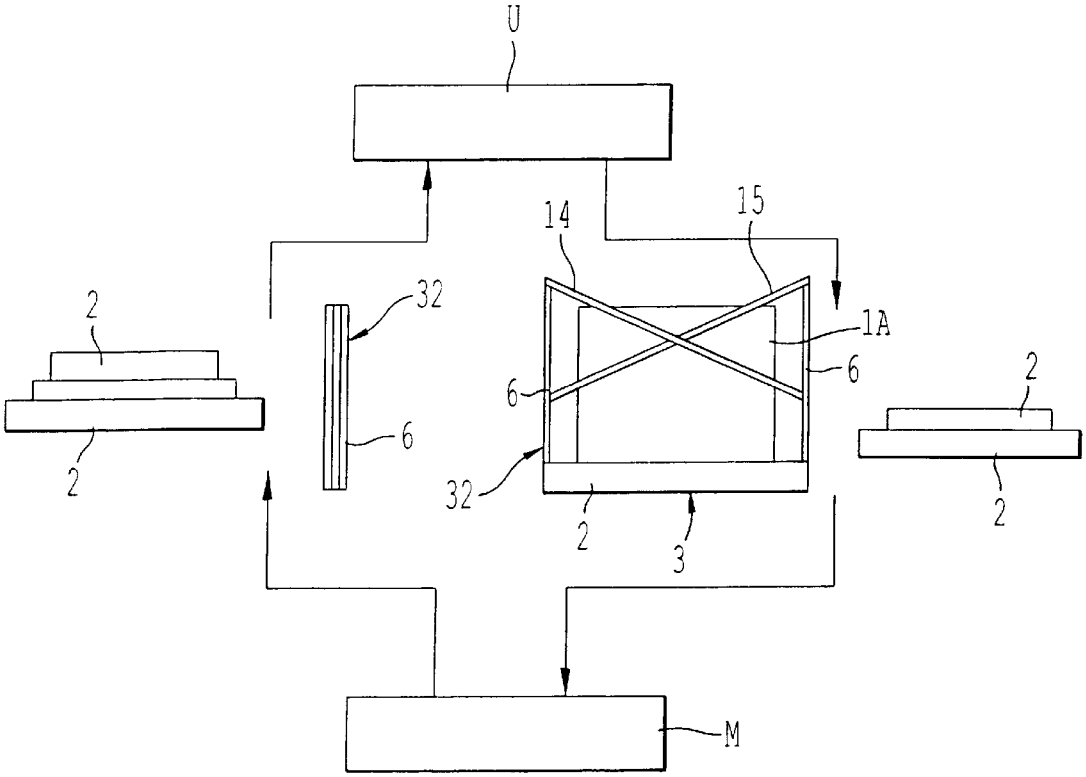
FIG. 17 shows a method for handing goods in which used goods are picked up.

As shown in FIG. 17, when goods, for example, a copying machine having been used thus far by a user has become unnecessary and the copying machine is to be traded-in by a recycling dealer M, it has been necessary for the recycling dealer M to previously check the size and the shape of the used goods to pick up from the user U side and carry a transporting tool of any size, with which the used goods can be transported based on the information, to the user. However, the dealer sometimes cannot acquire the information such as the size of used goods from a user side, and such a case may cause a mix-up. While, by using the goods loading apparatus 3, such problems can be solved.

At first, the recycling dealer M prepares a plurality pieces of goods loading members 2 of different sizes and also prepares support units 32 (a set of support unit 32 in the example of FIG. 17) by the number required for the number of goods to pick up. The dealer M carries them to a destination for picking up used goods, a user U in this case. At the destination, the recycling dealer M selects a goods loading member 2 according to the size, the shape, and the quantity of the trade-in goods, loads the trade-in goods 1A onto the selected goods loading member 2, attaches supports 6 in which a space between two adjacent supports is adjustable to the goods loading member 2, and transports the used goods 1A.

According to the method for handling goods, even when a recycling dealer is not previously informed of information such as the size of goods 1A to pick up from a user, the recycling dealer can pick up the goods 1A from the user without any trouble and transport them. The recycling dealer M needs to carry a plurality of goods loading members 2 and support units 32 to a user, but, since the goods loading members 2 and the support units 32 can be separated from each other and the goods loading members 2 can be piled up. Thus, these members and units can be made extremely compact and transported to the user. Further, by using the goods loading member 2 whose size can be enlarged or contracted as explained above, the quantity of goods loading members 2 which the recycling dealer carries to the user can be reduced, or the recycling dealer can pickup used goods 1A of any sizes without any trouble by carrying only one piece of goods loading member 2 to the user. This case is the same as the case of using a top 33. By using a top 33 whose size is variable, the quantity of tops to be taken to a user can be reduced.

The recycling dealer makes a charge of a pickup fee for used goods 1A to a user or a manufacturer of the goods. At this time, a pickup fee for the used goods 1A may also be determined based on the size of the goods loading member 2 selected at the user or the area occupied by the goods on the goods loading member 2. For example, when the large-sized goods loading member 2 is used, the pickup fee is set higher as compared to the case of using a small-sized goods loading member 2. Since the size of the pick-up goods 1A substantially corresponds to the size of the goods loading member 2 with the goods loaded, a pickup fee for the goods 1A can appropriately and easily be determined. The same holds true for the case where a pickup fee is determined according to whether the area occupied by goods on the goods loading member 2 is large or small.

Figure 18:
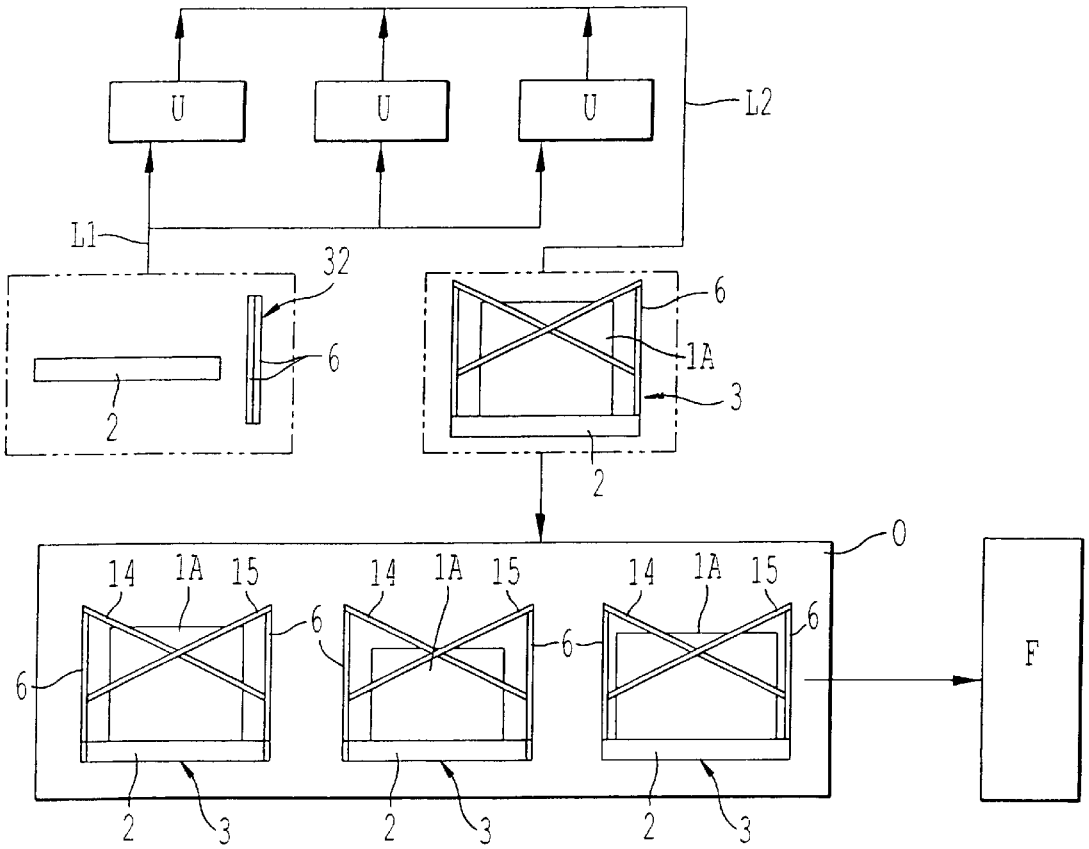
FIG. 18 shows a flow of goods when used goods are sold as second-hand ones.

When a user buys a new copying machine, for example, for an old one having been used by the user, there is sometimes a case where the used goods can still run in good condition. Such goods are sold to a third party as a second-hand item. In that case, it is conceivable that used goods traded-in from the users are transported to a large site such as a sales exhibit and the goods are to be sold at the site by putting a price on each of the goods or by auction. In this case, by using the goods loading apparatus 3, the goods can efficiently be transported and exhibited. FIG. 18 shows a schematic view of an example of the case.

As shown in FIG. 18, when a user U buys new goods such as a copying machine or a PC for used ones, the used goods are traded-in from the user U. Especially, when the user is a corporation, it is quite possible that a large quantity of used goods are traded-in at one time. A broker, for example, carries at least one piece of goods loading members 2 and support units 32 to users as indicated by L1 in FIG. 18, loads used goods 1A traded-in from each user on the respective goods loading member 2 according to each size of the goods. The broker adjusts each space between supports 6 based on each size, attaches the supports to each of the goods loading members 2, and transports the apparatuses to a sales exhibit 0 as indicated by L2 in FIG. 18. The broker does not unload the goods 1A from the goods loading apparatus 3 but exhibits the goods 1A as they are, and sells them. At that time, the goods 1A can be sold by auction or by putting a price on each of the goods 1A.

During the exhibiting, the goods loading apparatus 3 according to this embodiment is located in a state where supports 6 are provided apart from each other and slim bar-shaped or rod-shaped coupling members 14 and 15 are crossed between two adjacent supports 6. Accordingly, those who have come up to the sales exhibit O and want to buy goods are able to see the goods 1A loaded on the goods loading member 2 of the goods loading apparatus 3 from the outside. Accordingly, any of those who wish to buy goods can decide purchase of goods without worrying about the goods by visually checking the target goods. As explained above, by using a goods loading apparatus through which the goods loaded in the goods loading apparatus 3 are visible from the outside, the goods 1A can be checked without being unloaded from the goods loading apparatus 3.

As explained above related to FIG. 1, the goods are covered with the cover 8 and can be loaded in the goods loading apparatus 3. In the case of the example shown in FIG. 18, by covering the goods 1A with a cover to be loaded into the goods loading apparatus 3, the goods 1A can be protected more securely. In that case, by using a cover, for example, a cover made of a transparent resin sheet or a net, through which the covered goods 1A are visible from the outside, the goods 1A inside the cover can visually be checked. Thus, the cover will not possibly disturb the state where the goods 1A are checked.

Alternatively, the goods 1A remain loaded on the goods loading member 2, while the supports 6 and the coupling members 14 and 15 are detached from the goods loading member 2, and then the goods 1A are exhibited, so that those who want to buy goods can check the goods 1A more carefully. The work to detach the supports 6 and the coupling members 14 and 15 from the goods loading member 2 can easily be carried out.

At the sales exhibit O, when any of those who want to buy goods decides purchase of the goods 1A, the broker transports the used goods which have been purchased, that is, the second-hand goods 1A remaining loaded in the goods loading apparatus 3 to the dealer F to pick them up, i.e., the purchaser. The broker then unloads the goods 1A there, and detaches the support unit consisting of the supports 6 and the coupling members from the goods loading member 2 of the goods loading apparatus 3 to return them to their original location. When the supports 6 have been detached from the goods loading member 2 at the time of exhibiting the goods 1A, the supports 6 are attached to the goods loading member 2 with the goods 1A loaded to construct the goods loading apparatus 3, and transports the apparatus to the dealer F to pick up the goods.

In the event that there is no one to want to buy the goods 1A, the broker transports the goods 1A remaining loaded in the goods loading apparatus 3 to a dealer F who takes them such as a recycling dealer, where the goods 1A are subjected to processing for recycling.

As explained above, used goods 1A are loaded in a goods loading apparatus 3 in which a space between supports is adjusted according to the size, the shape, and the quantity of the used goods 1A to transport them to a sales exhibit O. The used goods 1A remaining loaded on the goods loading member 2 of the goods loading apparatus 3 are exhibited at the sales exhibit O, and the goods loading apparatus 3 with the used goods loaded is transported to a dealer F to pick up the used goods 1A. According to the method for handling goods by using such a goods loading apparatus 3, the goods 1A are transported efficiently to a sales exhibit O by the goods loading apparatus 3 in which a space between supports is adjusted according to the size of the used goods. The goods 1A remaining loaded on the goods loading member 2 of the goods loading apparatus 3 are then exhibited. Further, the goods loading apparatus 3 with the goods 1A remaining loaded can be transported to a dealer F to pick them up. Thus, the goods 1A can be efficiently handle/at a very low cost.

By the way, goods such as a copying machine or any other electric appliances are usually accompanied with an instruction manual. When such goods are to be transported, the instruction manual is also transported with the goods. At that time, since the structure of the goods loading apparatuses as shown in FIG. 1, FIG. 8, or FIG. 11 is very simply, it may be difficult to accommodate the instruction manual in any part of this goods loading apparatus. To solve the problem, in the method for handling goods, by putting the instruction manual of the goods in a case 33A, as shown in FIG. 7, other than the goods loading apparatus 3 to transport it, inconvenience such that the instruction manual maybe lost can be prevented. When the top 33 is used, the case with the instruction manual is placed on the top surface of the top 33, and the case can also be fixed to the top 33 with an adhesive tape or the like.

Figure 19A:
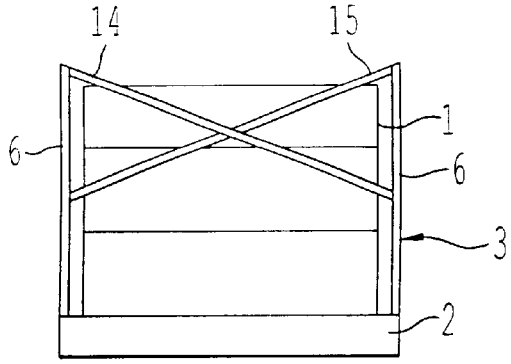
FIG. 19A to FIG. 19C show a method for determining transportation charges when goods are transported.
Figure 19B:
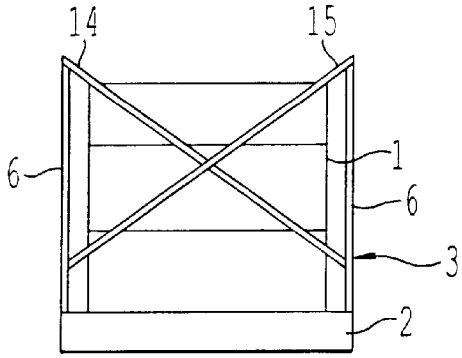
Figure 19C:
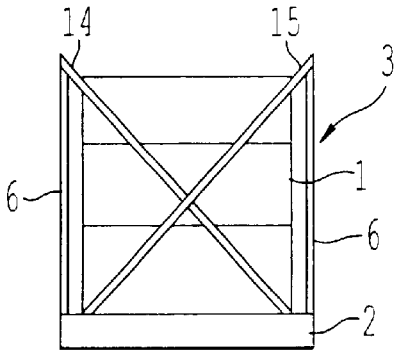

Further, the goods loading apparatus 3 can be utilized efficiently, for example, in a case of a move or when goods are transported via parcel delivery service or the like. In the case of a move, as shown in FIG. 19A, a forwarding agent loads the goods loading apparatus 3 with goods 1, that is, baggage of a client, and transports them by a truck or the like from one place to another. In this case, by determining transportation charges based on at least one of the volume of the goods loading apparatus 3 when the goods loading apparatus 3 has been loaded with the goods 1 and the size of the goods loading member 2, the transportation charges can easily be calculated. As shown in FIG. 19A, FIG. 19B, and FIG. 19C, when the goods 1 are to be loaded on each of the goods loading apparatuses 3, a goods loading member 2, according to the volume of the goods 1, is used, and a space between supports 6 is adjusted according to the size of the goods loading member 2. Therefore, the volume of each of the goods loading apparatuses 3 or the size of the goods loading member 2 may be different, depending on the quantity of the goods 1 to be transported. Therefore, each volume of the goods loading apparatuses 3 is calculated, and transportation charges are determined according to the volume or the size of the goods loading member 2. At that time, the charges can be determined step by step such that Y dollars are charged for the volume up to X, and Y1 dollars are charged for the volume more than X to X1. According to the method for handling goods using the goods loading apparatus 3 as explained above, transportation charges can easily and appropriately be calculated. In this case, the goods loading apparatus, through which loaded goods 1 can visually be checked from the outside, is also used. At the same time, when the goods 1 are spread over with a cover, any cover through which the goods inside the cover can be seen from the outside is used. Accordingly, the goods 1 loaded in the goods loading apparatus 3 can visually be checked. Thus, the relevant goods 1 can be transported to a specified site without fail. The same holds true for the case of the method for handling any of the goods explained above.

For reference purposes, goods that can be handled by the method, storage sites when the goods are stored, and means of transportation for the goods are listed as follows.

Goods to be handled include those as follows:

1. Finished products of self-propelled devices such as powered travel devices or non-powered travel devices. For example, two-wheeled vehicles, and bicycles.

2. Finished products of non-self-propelled devices such as image processors, electrical appliances, or products with no power supply required. For example, copying machines, business machines, office machines, printers, washing machines, refrigerators, machining tools, measuring instruments, furniture, desks, and articles for daily use.

3. Self-propelled devices or non-self-propelled devices that do not function singly such as half-finished products or units. For example, fixing units, and cartridges.

4. Parts forming a device such as components or complex (assembly) parts. For example, exterior covers, motors, engines, and cathode ray tubes.

5. Vessels containing liquid, gas, or a solid burned to produce heat or power such as vessels containing liquid, gas, or solid fuel. For example, gasoline storage tanks, kerosene tanks, various types of containers containing gas such as propane gas, and containers for coal and coke and so on.

6. Solids burned to produce heat or power such as solid fuel. For example, firewood, and charcoal.

7. Things such as a container with liquid, gas, or a solid to allow it to be transported or stored. For example, glass bottles, other types of bottles, aluminum cans, and steel cans.

8. Things that do not belong to food and drink such as oil-refined products. For example, resin beads, and resin pellets.

9. Food and drink such as grain, powder, beans. For example, rice, flour, and Soya beans.

Storage sites for goods loaded in the goods loading apparatus includes those as follows:

1. Buildings with a mechanism to protect them from being affected by weather such as buildings with roof. For example, warehouses, factories, truck terminals, and stores.

2. Sites, such as a flatland or a partitioned land, where goods are stored or piled up. For example, container yards, parking lots, and gardens.

Means for transporting the goods loading apparatus with goods loaded include those as follows:

1. Means of transportation with a mechanism to protect them from being affected by weather such as means of aerial transportation with roof. For example, airplanes.

2. Means of transportation with a mechanism to protect them from being affected by weather such as means of sea transportation with roof. For example, ships.

3. Means of transportation with a mechanism to protect them from being affected by weather such as means of land transportation with roof. For example, trucks with a panel, and trailers.

4. Means of transportation without a mechanism to protect them from being affected by weather such as means of land transportation without roof. For example, flatbed trucks, hand pallets, and flatbed pushcarts.

In this invention, the respective structures can also be combined with each other as required.

According to one aspect of this invention, goods can efficiently be transported, stored, or exhibited.

Further, a variety of goods can be held on the goods loading member, thus increasing the convenience of handling goods.

Further, a member is provided above goods, thus enhancing the function of protecting goods.

Further, the protective member or the supporting member is deformable, thus easily handling the member.

Further, the protective member or supporting member can be reused, thus increasing the cost efficiency of the member.

According to another aspect of this invention, by adjusting a space between supports, goods of various sizes, forms, quantities can easily be transported, stored, or exhibited.

According to still another aspect of this invention, a goods loading apparatus remaining empty is not returned, which allows the utilizing efficiency of the apparatus to be increased.

According to still another aspect of this invention, the space between supports is adjusted according to the size, the shape, or the quantity of trade-in goods, thus transporting various types of trade-in goods.

According to still another aspect of this invention, the goods loading member used at the time of manufacturing goods can be transported with the goods loaded, thus increasing the efficiency of handling goods.

According to still another aspect of this invention, goods manufactured at different sites can efficiently be put together at an assembly site different from these sites.

According to still another aspect of this invention, used goods can efficiently be transported.

Further, the pickup fee for used goods can quickly and appropriately be determined.

According to still another aspect of this invention, used goods can be sold while being efficiently distributed.

Further, even if an instruction manual accompanies goods, the manual can easily be transported.

According to still another aspect of this invention, a forwarding agent can quickly and appropriately determine transportation charges.

Further, goods to be handled can be protected more securely.

Further, goods can be checked from outside of a cover, thus increasing the efficiency of handling goods.

Further, goods can be checked from outside of a goods loading apparatus, thus increasing the efficiency of handling goods.

Further, goods are unloaded from a goods loading apparatus, and then its supports can be folded up to be compact, which allows these members to efficiently be transported.

The present document incorporates by reference the entire contents of Japanese priority documents, 11-361711 filed in Japan on Dec. 20, 1999.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A method for handling goods, comprising:

at least one of transporting, storing, and exhibiting goods using (1) a goods loading member onto which the goods are loaded, and (2) a protective member, which includes plural movable upright members, that protects the goods on the goods loading member, wherein the protective member is slidably movable in a vertical direction for changing a horizontal distance between at least two upright members of the plural upright members.

2. The method for handling goods according to claim 1, wherein the goods loading member is configured to hold different types of goods.

3. The method for handling goods according to claim 1, wherein a second goods loading member is provided above the goods.

4. The method for handling goods according to claim 1, wherein a second goods loading member and a second protective member are provided above the goods.

5. The method for handling goods according to claim 1, wherein the protective member is deformable.

6. The method for handling goods according to claim 1, wherein the protective member can be disassembled to a plurality of members.

7. The method for handling goods according to claim 1, wherein the protective member is formed with at least one of metal, resin, and wood.

8. The method for handling goods according to claim 1, wherein the protective member is made of a reusable member.

9. A method for handling goods when transporting, storing, or exhibiting goods using a goods loading member, comprising:

loading the goods;

attaching a supporting member, which includes plural movable upright members, to the goods loading member; and supporting a supported member by the supporting member, wherein the supporting member is slidably movable in a vertical direction for changing a horizontal distance between at least two upright members of the plural upright members.

10. The method for handling goods according to claim 9, wherein the supporting member is deformable.

11. The method for handling goods according to claim 9, wherein the supporting member can be disassembled to a plurality of members.

12. The method for handling goods according to claim 9, wherein the supported member is a cover provided above the goods.

13. The method for handling goods according to claim 9, wherein the supported member is another goods loading member.

14. The method for handling goods according to claim 9, wherein the supported member includes a second goods loading member and a second supporting member which are located above the goods.

15. The method for handling goods according to claim 9, wherein the supporting member is formed with at least one of metal, resin, and wood.

16. The method for handling goods according to claim 9, wherein the supporting member is made of a reusable member.

17. A method for handling goods, comprising:

loading goods into a goods loading apparatus that comprises a goods loading member onto which goods are loaded and a plurality of supports spaced on and detachably attached to the goods loading member so as to surround the goods on the goods loading member, and in which two adjacent supports are coupled to each other so as to enable adjustment of the space between the two supports by making the two adjacent supports closer to or farther apart from each other; and at least one of transporting, storing, and exhibiting the goods.

18. The method for handling goods according to claim 17 further comprising the step of transporting an instruction manual for goods put in a case different from the goods loading apparatus.

19. The method for handling goods according to claim 17 further comprising the steps of covering goods with a cover and loading the goods into a goods loading apparatus.

20. The method for handling goods according to claim 19, further comprising:

arranging the cover such that the goods covered with the cover are visible from the outside.

21. The method for handling goods according to claim 17, wherein the goods loaded in the goods loading apparatus are visible from the outside.

22. The method for handling goods according to claim 17, further comprising:

loading goods into a goods loading apparatus that allows a plurality of supports detached from the goods loading member to be closer to each other, keeping the supports in a substantially parallel state, and folded up.

23. A method for handling goods comprising:

loading goods into a goods loading apparatus that comprises a goods loading member onto which goods are loaded and a plurality of supports spaced on and detachably attached to the goods loading member so as to surround the goods on the goods loading member, and in which two adjacent supports are coupled to each other so as to enable adjustment of the space between the two supports by making the two adjacent supports closer to or farther apart from each other;

transporting the goods;

unloading the goods from the goods loading apparatus;

loading trade-in goods into the goods loading apparatus; and transporting the trade-in goods to other sites.

24. The method for handling goods according to claim 23 further comprising the step of transporting an instruction manual for goods put in a case different from the goods loading apparatus.

25. The method for handling goods according to claim 23 further comprising the steps of covering goods with a cover and loading the goods into a goods loading apparatus.

26. The method for handling goods according to claim 25, further comprising:

arranging the cover such that the goods covered with the cover are visible from the outside.

27. The method for handling goods according to claim 23, wherein the goods loaded in the goods loading apparatus are visible from the outside.

28. The method for handling goods according to claim 23, further comprising:

loading goods into a goods loading apparatus that allows a plurality of supports detached from the goods loading member to be closer to each other, keeping the supports in a substantially parallel state, and folded up.

29. A method for handling goods, comprising:

loading goods into a goods loading apparatus that comprises a goods loading member onto which the goods are loaded and a plurality of supports spaced on and detachably attached to the goods loading member so as to surround the goods on the goods loading member, and in which two adjacent supports are coupled to each other so as to enable adjustment of the space between the two supports by making the two adjacent supports closer to or farther apart from each other;

transporting the goods;

unloading the goods from the goods loading apparatus;

loading trade-in goods into a goods loading apparatus in which a space between supports are adjusted according to a size, a shape, and a quantity of the trade-in goods; and transporting the trade-in goods to other sites.

30. The method for handling goods according to claim 29 further comprising the step of transporting an instruction manual for goods put in a case different from the goods loading apparatus.

31. The method for handling goods according to claim 29 further comprising the steps of covering goods with a cover and loading the goods into a goods loading apparatus.

32. The method for handling goods according to claim 31, further comprising:

arranging the cover such that the goods covered with the cover are visible from the outside.

33. The method for handling goods according to claim 29, wherein the goods loaded in the goods loading apparatus are visible from the outside.

34. The method for handling goods according to claim 29, further comprising:

loading goods into a goods loading apparatus that allows a plurality of supports detached from the goods loading member to be closer to each other, keeping the supports in a substantialy parallel state, and folded up.

35. A method for handling goods, comprising:

manufacturing goods on a goods loading member; and attaching a plurality of supports, in which a space between two adjacent supports is adjustable by making the two adjacent supports closer to or farther apart from each other, to the goods loading member by a time the goods are shipped.

36. The method for handling goods according to claim 35 further comprising the step of transporting an instruction manual for goods put in a case different from the goods loading apparatus.

37. The method for handling goods according to claim 35 further comprising the steps of covering goods with a cover and loading the goods into a goods loading apparatus.

38. The method for handling goods according to claim 37, further comprising:

arranging the cover such that the goods covered with the cover are visible from the outside.

39. The method for handling goods according to claim 35, wherein the goods loaded in the goods loading apparatus are visible from the outside.

40. The method for handling goods according to claim 35, further comprising:

loading goods into a goods loading apparatus that allows a plurality of supports detached from the goods loading member to be closer to each other, keeping the supports in a substantially parallel state, and folded up.

41. A method for handling goods, comprising:

loading respective goods to be assembled, at different sites, into a plurality of goods loading apparatuses, each comprising a goods loading member onto which goods are loaded and a plurality of supports spaced on and detachably attached to the goods loading member so as to surround the goods on the goods loading member, and in which two adjacent supports are coupled to each other so as to enable adjustment of the space between the two supports by making the two adjacent supports closer to or farther apart from each other;

transporting the goods loading apparatuses to an assembly site;

detaching the plurality of supports of one of the goods loading apparatuses from the respective goods loading member, but not unloading the goods loaded on said one of the goods loading apparatuses from the respective goods loading member at the assembly site;

mounting goods unloaded from the other of the goods loading apparatuses to the goods on the respective goods loading member;

attaching the plurality of supports to the respective goods loading member at the assembly site; and transporting the goods loaded on said one of the goods loading apparatuses to other sites.

42. The method for handling goods according to claim 41 further comprising the step of transporting an instruction manual for goods put in a case different from the goods loading apparatus.

43. The method for handling goods according to claim 41 further comprising the steps of covering goods with a cover and loading the goods into a goods loading apparatus.

44. The method for handling goods according to claim 43, further comprising:

arranging the cover such that the goods covered with the cover are visible from the outside.

45. The method for handling goods according to claim 41, wherein the goods loaded in the plurality of the goods loading apparatuses are visible from the outside.

46. The method for handling goods according to claim 41, further comprising:

loading goods into a goods loading apparatus that allows the plurality of supports detached from the respective goods loading member to be closer to each other, keeping the supports in a substantially parallel state, and folded up.

47. A method for handling goods, comprising:

preparing a plurality of goods loading members of different sizes and visiting a site to pick up used goods with the plurality of goods loading members;

selecting one of the plurality of goods loading members matching a size, a shape, and a quantity of the used goods to be picked up;

loading the used goods onto the selected goods loading member;

attaching a plurality of supports, in which a space between two adjacent supports is adjustable by making the two adjacent supports closer to or farther apart from each other, to the selected goods loading member; and transporting the used goods.

48. The method for handling goods according to claim 47, further comprising:

determining a pickup fee for the used goods based on one of a size of the selected goods loading member and an area occupied by the used goods on the selected goods loading member.

49. The method for handling goods according to claim 47 further comprising the step of transporting an instruction manual for goods put in a case different from the goods loading apparatus.

50. The method for handling goods according to claim 47 further comprising the steps of covering goods with a cover and loading the goods into a goods loading apparatus.

51. The method for handling goods according to claim 50, further comprising:

arranging the cover such that the goods covered with the cover are visible from the outside.

52. The method for handling goods according to claim 47, wherein the goods loaded in the goods loading apparatus are visible from the outside.

53. The method for handling goods according to claim 47, further comprising:

loading goods into a goods loading apparatus that allows a plurality of supports detached from the goods loading member to be closer to each other, keeping the supports in a substantially parallel state, and folded up.

54. A method for handling goods by using a goods loading apparatus comprising a goods loading member onto which goods are loaded and a plurality of supports spaced on and detachably attached to the goods loading member so as to surround the goods on the goods loading member, and in which two adjacent supports are coupled to each other so as to enable adjustment of the space between the two supports by making the two adjacent supports closer to or farther apart from each other, comprising:

loading used goods into the goods loading apparatus in which a space between supports is adjusted according to a size, a shape, and a quantity of the used goods;

transporting the used goods to a sales exhibit;

exhibiting the used goods, which remain loaded on the goods loading member of the goods loading apparatus at the sales exhibit; and transporting the used goods loaded on the goods loading apparatus to one who picks up the used goods.

55. The method for handling goods according to claim 54 further comprising the steps of transporting an instruction manual for goods put in a case different from the goods loading apparatus.

56. The method for handling goods according to claim 54 further comprising the steps of covering goods with a cover and loading the goods into a goods loading apparatus.

57. The method for handling goods according to claim 56, further comprising:

arranging the cover such that the goods covered with the cover are visible from the outside.

58. The method for handling goods according to claim 54, wherein the goods loaded in the goods loading apparatus are visible from the outside.

59. The method for handling goods according to claim 54, further comprising:

loading goods into a goods loading apparatus that allows a plurality of supports detached from the goods loading member to be closer to each other, keeping the supports in a substantially parallel state, and folded up.

60. A method for handling goods by using a goods loading apparatus comprising a goods loading member onto which goods are loaded and a plurality of supports spaced on and detachably attached to the goods loading member so as to surround the goods on the goods loading member, and in which two adjacent supports are coupled to each other so as to enable adjustment of the space between the two supports by making the two adjacent supports closer to or farther apart from each other, comprising:

determining transportation charges based on at least one of a volume of the goods loading apparatus and a size of the goods loading member when the goods are loaded in the goods loading apparatus when a forwarding agent transports the goods from one place to another.

61. The method for handling goods according to claims 60 to 28 further comprising the steps of covering goods with a cover and loading the goods into a goods loading apparatus.

62. The method for handling goods according to claim 61, further comprising:

arranging the cover such that the goods covered with the cover are visible from the outside.

63. The method for handling goods according to claim 60, wherein the goods loaded in the goods loading apparatus are visible from the outside.

64. The method for handling goods according to claim 60, further comprising loading goods into a goods loading apparatus that allows a plurality of supports detached from the goods loading member to be closer to each other, keeping the supports in a substantially parallel state, and folded up.

* * * * *